US006392390B1

(12) United States Patent
Ito et al.

(10) Patent No.: US 6,392,390 B1
(45) Date of Patent: May 21, 2002

(54) SYNCHRONOUS SWITCHING APPARATUS FOR USE WITH A MULTIPLE PHASE POWER SYSTEM

(75) Inventors: Hiroki Ito; Haruhiko Kohyama; Mikio Hidaka, all of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/508,364

(22) PCT Filed: Jul. 16, 1998

(86) PCT No.: PCT/JP98/03204

§ 371 Date: Mar. 10, 2000

§ 102(e) Date: Mar. 10, 2000

(87) PCT Pub. No.: WO00/04564

PCT Pub. Date: Jan. 27, 2000

(51) Int. Cl.[7] ..... G05F 1/70

(52) U.S. Cl. ..... 323/209; 323/207

(58) Field of Search ..... 323/205, 207, 323/210, 211, 209, 215, 218; 361/8, 9, 13

(56) References Cited

U.S. PATENT DOCUMENTS

| | | | | |
|---|---|---|---|---|
| 4,419,621 A | * | 12/1983 | Becker et al. | 324/51 |
| 5,467,241 A | * | 11/1995 | Sugitani et al. | 361/63 |
| 5,654,625 A | * | 8/1997 | Konstanzer et al. | 323/211 |
| 5,963,021 A | * | 10/1999 | Rostron et al. | 323/210 |

FOREIGN PATENT DOCUMENTS

| | | |
|---|---|---|
| JP | 55-93619 | 7/1980 |
| JP | 61-296624 | 12/1986 |
| JP | 6-52759 | 2/1994 |

OTHER PUBLICATIONS

K.C. Liu and N. Chen, "Voltage–peak synchronous closing control for shunt capacitors", May 1998 IEEE, pp 233–238.*

"Controlled Switching—A State–of–the–Art Survey" Part I and II, Electra 162, 164, Oct. 1995 and Feb. 1996, respectively.

"Point–on–Wave Controlled Switching of High Voltage Circuit–Breakers" by Moraw et al, CIGRE 1988 Session 13–02 Aug. 1988.

* cited by examiner

*Primary Examiner*—Peter S. Wong
*Assistant Examiner*—Gary L. Laxton
(74) *Attorney, Agent, or Firm*—Sughrue Mion, PLLC

(57) ABSTRACT

A synchronous switching apparatus for detecting a source voltage of each phase to close each phase at an electrical phase angle predetermined for each phase, including switching devices 1*a*–1*c* provided one for each phase for opening and closing an impedance load, switching devices 2*a*–2*c* for closing and opening the switching devices 1*a*–1*c* for each phase, measuring transformers 5*a*–5*c* for measuring source voltages of the respective phases and phase-to-phase voltages, and phase control devices 42 each for issuing a command for energizing the impedance load at an electrical phase angle in a range predetermined for each phase, when detecting a zero point of a source voltage of each phase or a zero point of each phase-to-phase voltage.

19 Claims, 11 Drawing Sheets

OPTIMUM ENERGIZING TIMING AND MAGNETIC FLUX VARIATION FOR A STAR CONNECTION TRANSFORMER, OR SHUNT REACTOR, WITH THE NEUTRAL POINT GROUNDED

Vr: R-Phase voltage Vt: T-Phase voltage Vs: S-Phase voltage
Φs: S-Phase magnetic flux Φr: R-Phase magnetic flux Φt: T-Phase magnetic flux OPTIMUM ENERGIZING TIMING AND MAGNETIC FLUX VARIATION FOR A DELTA CONNECTION TRANSFORMER, OR SHUNT REACTOR Vrs: R-S Interphase voltage Vtr: T-R Interphase voltage Vst: S-T Interphase voltage Vr: R-Phase voltage Vt: T-Phase voltage Vs: S-Phase voltage Φs: S-Phase magnetic flux Φr: R-Phase magnetic flux Φt: T-Phase magnetic flux OPTIMUM ENERGIZING TIMING AND MAGNETIC FLUX VARIATION FOR A CAPACITOR BANKS WITH THE NEUTRAL POINT UNGROUNDED OR TRANSMISSION LINES Vrs: R-S Interphase voltage Vtr: T-R Interphase voltage Vst: S-T Interphase voltage Vr: R-Phase voltage Vt: T-Phase voltage Vs: S-Phase voltage Jtr: T-R Interphase current Jt: T-Phase current Js: S-Phase current Jr: R-Phase current

SYNCHRONOUS SWITCHING APPARATUS FOR USE WITH A MULTIPLE PHASE POWER SYSTEM

TECHNICAL FIELD

The present invention relates to a synchronous switching apparatus for use with a multiple phase power system that controls the opening and closing timing of a power switch to suppress the occurrence of exciting inrush currents and surge voltages, which are hard on system equipment such as transformer, shunt reactor, power-transmission lines and capacitor banks.

BACKGROUND ART

In the closing and opening of a power switch, many methods for suppressing transient phenomena that are hard on system equipment have been proposed. For example, "Development of a gas-blast circuit breaker for 1000 kV GIS," included in The 1994 Electric Society National Symposium Proceedings, pages 1453–1455, describes power switching equipment (circuit breaker) in which as means for suppressing surge voltages generated in system equipment such as transformer and shunt reactor, a resistor on the order of 500 to 1000 ohms is inserted before closing the switching equipment. FIG. 7 shows the case in which a shunt reactor is energized by using this resistor insertion technique. In FIG. 7, (1*a*), (1*b*), and (1*c*) are switching devices provided for R, S and T phases, respectively; (2*a*), (2*b*), and (2*c*) are switching devices for closing or opening the switching device for the R, S and T phases, respectively; (8*a*), (8*b*) and (8*c*) are switches for inserting resistors (7*a*), (7*b*) and (7*c*), respectively, which are connected in parallel with the switching devices for the R, S and T phases, respectively; (9*a*), (9*b*) and (9*c*) are reactor banks to be inserted; (5*a*), (5*b*) and (5*c*) are measuring transformers used for measuring the source voltage of each of the R, S and T phases, respectively; and (4) is a control device for issuing closing commands to each switching device (1) and each switch (8).

When the switching devices of the conventional resistor insertion technique configured in this way are used to energize the reactor banks (9), first, the control device (4) issues a closing command to each of the switches (8*a*), (8*b*) and (8*c*), and source voltage are applied to the reactor banks (9) through the resistors (7*a*), (7*b*) and (7*c*). The currents caused by transient surge voltages upon inserting the resistors are rapidly damped by the resistors. Therefore, a voltage of small amplitude and having the same frequency as the source voltage is applied to the reactor banks (9). Subsequently, the control device(4) issues closing commands to each of switching mechanism (2*a*), (2*b*) and (2*c*). Then, when the switching equipment is closed, transient phenomena can be suppressed and exciting inrush currents flowing into the reactor banks (9) can be also suppressed, because a voltage of the same phase as that of the source voltage has already been applied to the reactor banks (9) through the resistors.

However, this method has problems in that the switching equipment is not only comparatively expensive but also large because the method requires that the resistor elements and the switches for inserting the resistors having the capacity needed for each piece of equipment, must be provided inside the switching equipment.

Further, in the case of energizing transmission lines, it is impossible to suppress surges with the inserting resisters if the lines are long. Therefore, when energizing system equipment such as transformer and shunt reactor, in principle, the occurrence of transient exciting inrush currents and surge voltages can be suppressed by energizing at the peak value (an electrical phase angle of 90 degrees) of the source voltage. This is discussed by CIGRE et al. and disclosed in "Controlled Switching", ELECTRA. NO. 164, (1995) and ELECTRA. NO. 165, (1995).

FIG. 8 shows an operating sequence when a transformer is energized using this synchronous switching apparatus. In FIG. 8, (1*a*), (1*b*) and (1*b*) are switching devices provided for the R, S and T phases, respectively; (2*a*), (2*b*) and (2*c*) are switching mechanisms for closing or opening the switching devices for the R, S and T phases, respectively; (3) is a transformer to be energized; (5*a*), (5*b*) and (5*c*) are measuring transformers used for measuring the respective source voltage of the R, S and T phases; (40) is a phase control device for issuing closing commands to the switch mechanism (2) of each switching device (1).

When the transformer (3) is energized using the synchronous switching apparatus configured in this way, first the transformers (5*a*), (5*b*) and (5*c*) used for measuring the respective source voltage of the R. S and T phases detect the zero points of the respective source voltage of the R. S and T phases. The phase control device(40) estimates "a pole-closing time Tc" which is the time until an electrical phase angle of a certain ideal angular phase is reached based on the operating time of the switching mechanism as determined from the temperature, operating voltages and past operating history as shown in FIG. 9, and then adjusts "the delay time Td" for outputting a closing signal such that closing may be established at a closing time Ta corresponding to the target electrical phase angle of each of the R, S and T phases, and provides a closing command to each of the switching mechanism (2*a*), (2*b*) and (2*c*). By closing the switching equipment for the transformer (3) at the predetermined closing time according to this command, in principle, transient phenomena can be suppressed.

Further, "Development of a gas-blast circuit breaker for 1000 kV GIS", included in The 1994 Electric Society National Symposium Proceedings, pp. 1453–1455, illustrates a power switch (circuit breaker)" that suppresses surge voltages generated in system equipment, such as power-transmission lines and capacitor banks, by inserting a resistor on the order of 500 to 1000 ohms before closing the switching equipment, as shown in FIG. 10.

FIG. 10 shows the case of energizing capacitor banks using the switching equipment according to this resistor insertion technique. In this figure, similar reference characters are used to refer to portions that are identical or correspond to those in FIG. 7. In FIG. 10, (9*a*1), (9*b*1) and (9*c*1) show capacitor banks to be energized.

By using the conventional switching devices according to the resistor insertion technique configured as above, when the capacitor banks (9*a*1), (9*b*1) and (9*c*1) are energized, first the control device (4) issues a closing command to each of the switches (8*a*), (8*b*) and (8*c*), and source voltage are applied to the capacitor banks (9*a*1), (9*b*1) and (9*c*1) through the resistors (7*a*), (7*b*) and (7*c*).

A current occurring due to a transient surge voltage upon inserting the resistor(s) is rapidly damped by the resistor(s). Therefore, a voltage having a small amplitude and with the same frequency as the source voltage is applied to the capacitor banks (9*a*1), (9*b*1) and (9*c*1). Subsequently, the control device (4) issues a closing command to each of the switch mechanism (2*a*),. (2*b*) and (2*c*). Then, when the switching equipment is closed, transient phenomena can be suppressed and exciting inrush currents flowing into the capacitor banks (9*a*1), (9*b*1) and (9*c*1) can also be suppressed because a voltage which is in phase with the source voltage has already been applied to the capacitor banks (9*a*1), (9*b*1) and (9*c*1) through the resistors.

However, this method has problems in that the switching equipment is not only comparatively expensive but also has a large size because this method requires that the resistor elements and switches for inserting the resistors having the capacity needed for each piece of equipment, must be provided inside the switching equipment. Further, in the case of energizing transmission lines, it is impossible to suppress surges by inserting resisters for long transmission lines.

Therefore, when energizing system equipment such as transmission lines and capacitor banks, the occurrence of transient exciting inrush currents and surge voltages can be, in principle, suppressed by energizing at the zero point(0) of the electrical phase angle of the source voltage. This is discussed by CIGRE et al. and disclosed in "Controlled Switching", ELECTRA. NO. 164, (1995) and ELECTRA. NO. 165, (1995).

FIG. 11 shows an operating sequence when energizing a transformer using this synchronous switching equipment. In FIG. 11, (1*a*), (1*b*) and (1*c*) are switching devices provided for the R, S and T phases, respectively; (2*a*), (2*b*) and (2*c*) are switching devices for closing or opening the switching devices for the R, S and T phases, respectively; (3*a*), (3*b*) and (3*c*) are transmission lines to be energized, respectively; (5*a*), (5*b*) and (5*c*) transformers are used for measuring the source voltage of the R, S and T phases, respectively; a phase control device (40) issues a closing command to the switch mechanism (2) for each switching device (1).

In the synchronous switching apparatus structured as above, when energizing each of the transmission lines (3*a*), (3*b*) and (3*c*), first, the transformers (5*a*), (5*b*) and (5*c*) used for measuring the source voltage of each of the R, S and T phases detect the zero point of the source voltage of each of the R, S and T phases, respectively. The phase control device (40) estimates "a pole-closing time Tc" which is the time until an electrical phase angle of a certain ideal angular phase is reached based on the operating time of the switching mechanism as determined from the temperature, operating voltages and past operating history as shown in FIG. 12, and adjusts "the delay time Td" for outputting a closing signal such that closing may be established at a closing time Ta corresponding to the target electrical phase angle of each R, S and T phase to provide a closing command to each of the switching mechanisms (2*a*), (2*b*), (2*c*). By closing the switching equipment for the transmission lines (3*a*), (3*b*) and (3*c*) at the predetermined closing time according to this command, in principle, transient phenomena can be suppressed.

However, because the time required for closing switching equipment inevitably varies due to variations in mechanical characteristics and the occurrence of discharge, ideal closing is not always realized.

The present invention has been made to overcome the above-described problems, and an object of the invention is to provide feasible closing timing to the switching equipment for each phase.

SUMMARY OF INVENTION

The present invention overcomes the above described problems and achieves the above discussed objectives by providing a synchronous switching apparatus for use with a multiple phase power system having a plurality of phases and for detecting a source voltage of each phase and energizing each phase at an electrical phase angle predetermined for each phase. The synchronous switching apparatus includes a plurality of switching devices, one switching device being provided for each phase and opening and closing an impedance load. The synchronous switching apparatus further includes a plurality of switching mechanisms, which close and open the switching devices, and a plurality of voltage measuring transformers, which measure source voltages of the phases. In addition, the synchronous switching apparatus includes a plurality of phase-to-phase voltage measuring transformers, which measure respective phase-to-phase voltages, and a plurality of phase control devices. One phase control device is provided for each phase and issues a command to energize the impedance load with a source voltage at an electrical phase angle in a range predetermined for the phase, in response to detection of a zero point of a source voltage of the phase by the voltage measuring transformer or in response to detection of a zero point of the phase-to-phase voltage by the phase-to-phase voltage measuring transformer.

A second embodiment of the present invention provides a synchronous switching apparatus similar to that of the first embodiment for use with an impedance load in the form of a single-phase core transformer or shunt reactor with a neutral point grounded. For this embodiment, as well as for the third through nineteenth embodiments, the plurality of phases includes a first (R), a second (S), and a third (T) phase, and the plurality of voltage measuring transformers includes a first, a second, and a third voltage measuring transformer, which measure source voltages of the first, second, and third phases, respectively. In addition, the predetermined electrical phase angles of each of the first, second, and third phases are within a range of 90 degrees (voltage peak value of the R, S, and T phases)±90 degrees.

The impedance load is energized with a source voltage via a command sequence, wherein the phase control devices respectively issue a first command for energizing the first (R) phase at the predetermined electrical phase angle of the first phase in response to detection of a zero point of a first (R) phase source voltage by the first voltage measuring transformer, a second command for energizing the third (T) phase at the predetermined electrical phase angle of the third phase in response to detection of a zero point of a third (T) phase source voltage by the third voltage measuring transformer at a time around ⅓ of a cycle after an energizing time of the first (R) phase, and a third command for energizing the second (S) phase at the predetermined electrical phase angle of the second phase in response to detection of a zero point of a second (S) phase source voltage by the second voltage measuring transformer at a time around ⅓ of a cycle after an energizing time of the third (T) phase.

A third embodiment of the present invention provides a synchronous switching apparatus similar to that of the first embodiment for use with an impedance load in the form of a single-phase core transformer or shunt reactor with a neutral point grounded. The plurality of phase-to-phase voltage measuring transformers comprises a first-to-second (R-to-S), a second-to-third (S-to-T), and a third-to-first (T-to-R) phase voltage measuring transformer, which measure a first-to-second, a second-to-third, and a third-to-first phase voltage, respectively. The predetermined electrical phase angles of each of the first-to-second phase voltage, the second-to-third phase voltage, and the third-to-first phase voltage are within a range of 60 degrees ±20degrees.

The impedance load is energized with a source voltage via a command sequence, wherein the phase control devices respectively issue a first command for energizing the first (R) phase at the predetermined electrical phase angle of the first-to-second (R-to-S) phase voltage in response to detection of a zero point of the first-to-second phase voltage by the first-to-second phase voltage measuring transformer, a second command for energizing the third (T) phase at the predetermined electrical phase angle of the third-to-first (T-to-R) phase voltage in response to detection of a zero point of the third-to-first (T-to-R) phase voltage by the third-to-first phase voltage measuring transformer at a time around ⅓ of a cycle after an energizing time of the first phase, and a third command for energizing the second (S) phase at the predetermined electrical phase angle of the second-to-third (S-to-T) phase voltage in response to detection of a zero point of the second-to-third (S-to-T) phase voltage by the second-to-third phase voltage measuring transformer at a time around ⅓ of a cycle after an energizing time of the third (T) phase.

A fourth embodiment of the present invention provides a synchronous switching apparatus similar to that of the first embodiment for use with an impedance load in the form of a three-phase core transformer or shunt reactor having star-connected windings with a neutral point grounded. The plurality of voltage measuring transformers includes a first and a third voltage measuring transformer, which measure source voltages of the first and third phases, respectively. The predetermined electrical phase angle of the first phase is within a range of 90 degrees (voltage peak value of the R phase) ±20 degrees, and the electrical phase angle of the third phase is within a range of 60 degrees ±20 degrees.

The impedance load is energized with a source voltage via a command sequence, wherein the phase control devices respectively issue a first command for energizing the first (R) phase at the predetermined electrical phase angle of the first phase in response to detection of a zero point of a first (R) phase source voltage by the first voltage measuring transformer, a second command for energizing the third (T) phase at the predetermined electrical phase angle of the third phase in response to detection of a zero point of a third (T) phase source voltage by the third voltage measuring transformer at a time around ¼ of a cycle after an energizing time of the first (R) phase, and a third command for energizing the second (S) phase at any time after the energizing of the third (T) phase.

A fifth embodiment of the present invention provides a synchronous switching apparatus similar to that of the first embodiment for use with an impedance load in the form of a single-phase core transformer or shunt reactor with a neutral point grounded. The plurality of voltage measuring transformers includes a first and a second voltage measuring transformer, which measure source voltages of the first and second phases, respectively.

The predetermined electrical phase angle of the first phase is within a range of 90 degrees (voltage peak value of the R phase) ±20 degrees, and the predetermined electrical phase angle of the second phase is within a range of −30 degrees ±20 degrees.

The impedance load is energized with a source voltage via a command sequence, wherein the phase control devices respectively issue a first command for energizing the first (R) phase at the predetermined electrical phase angle of the first phase in response to detection of a zero point of the first (R) phase source voltage by the first voltage measuring transformer, a second command for energizing a second (S) phase at the predetermined electrical phase angle of the second phase in response to detection of a zero point of a second (S) phase source voltage by the second voltage measuring transformer at a time around ¼ of a cycle after an energizing time of the first (R) phase, and a third command for energizing the third (T) phase at any time after the energizing of the second phase.

A sixth embodiment of the present invention provides a synchronous switching apparatus similar to that of the first embodiment for use with an impedance load in the form of a single-phase core transformer or shunt reactor with a neutral point grounded. The plurality of phase-to-phase voltage measuring transformers includes a first-to-second (R-to-S) and a third-to-first (T-to-R) phase voltage measuring transformer, which measure a first-to-second and a third-to-first phase voltage, respectively.

The predetermined electrical phase angle of the first-to-second phase voltage is within a range of 60 degrees ±20 degrees, and the predetermined electrical phase angle of the third-to-first phase voltage is within a range of 30 degrees ±20 degrees.

The impedance load is energized with a source voltage via a command sequence, wherein the phase control devices respectively issue a first command for energizing the first (R) phase at the predetermined electrical phase angle of the first-to-second (R-to-S) phase voltage in response to detection of a zero point of the first-to-second phase voltage by the first-to-second phase voltage measuring transformer, a third command for energizing the third (T) phase at the predetermined electrical phase angle of the third-to-first (T-to-R) phase voltage in response to detection of a zero point of a third-to-first (T-to-R) phase voltage by the third-to-first phase voltage measuring transformer at a time around ⅓ of a cycle after an energizing time of the first (R) phase, and a second command for energizing the second (S) phase at any time after the energizing of the third (T) phase.

A seventh embodiment of the present invention provides a synchronous switching apparatus similar to that of the first embodiment for use with an impedance load in the form of a three-phase core transformer or shunt reactor having star-connected windings with a neutral point grounded. The plurality of phase-to-phase voltage measuring transformers comprises a first-to-second (R-to-S), and a second-to-third (S-to-T), which measure a first-to-second and a second-to-third phase voltage, respectively.

The predetermined electrical phase angles of the first-to-second and the second-to-third phase voltage are within a range of 60 degrees ±20 degrees and −60 degrees ±20 degrees, respectively.

The impedance load is energized with a source voltage via a command sequence, wherein the phase control devices respectively issue a first command for energizing the first (R) phase at the predetermined electrical phase angle of the first-to-second (R-to-S) phase voltage in response to detection of a zero point of the first-to-second (R-to-S) phase voltage by the first-to-second phase voltage measuring transformer, a second command for energizing the second (T) phase at the predetermined electrical phase angle of the second-to-third (S-to-T) phase voltage in response to detection of a zero point of the second-to-third (S-to-T) phase voltage by the second-to-third phase voltage measuring transformer at a time around ⅓ of a cycle after an energizing time of the first phase (R phase), and a third command for energizing the third (T) phase at any time after the energizing of the second (S) phase.

An eighth embodiment of the present invention provides a synchronous switching apparatus similar to that of the first embodiment for use with an impedance load in the form of a three-phase core transformer or shunt reactor having star-connected windings with a neutral point ungrounded, or a delta connection transformer or shunt reactor. The plurality of voltage measuring transformers includes a first and a third voltage measuring transformer, which measure source voltages of the first and third phases, respectively. The predetermined electrical phase angles of the first and third phases are within a range of 120 degrees ±20 degrees and 90 degrees ±20 degrees, respectively.

The impedance load is energized with a source voltage via a command sequence, wherein the phase control devices respectively issue a first command for energizing the second (S) phase at any time, a second command for energizing the first (R) phase at the predetermined electrical phase angle of the first (R) phase in response to detection of a zero point of a first (R) source voltage by the first voltage measuring transformer after the energizing of the second (S) phase, and a third command for energizing the third (T) phase at the predetermined electrical phase angle of the third (T) phase in response to detection of a zero point of a third (T) phase source voltage by the third voltage measuring transformer at a time around ⅓ of a cycle after an energizing time of the first (R) phase.

A ninth embodiment of the present invention provides a synchronous switching apparatus similar to that of the first embodiment for use with an impedance load in the form of a three-phase core transformer or shunt reactor having star-connected windings with a neutral point ungrounded, or a single-phase core and three-phase core delta connection transformer or shunt reactor. The plurality of voltage measuring transformers includes a second and a third voltage measuring transformer, measuring source voltages of the second and third phases, respectively. The predetermined electrical phase angles of the second and third phases are within a range of −120 degrees ±20 degrees and 90 degrees ±20 degrees, respectively.

The impedance load is energized with a source voltage via a command sequence, wherein the phase control devices respectively issue a first command for energizing the first (R) phase at any time, a second command for energizing the second (S) phase at the predetermined electrical phase angle of the second (S) phase in response to detection of a zero point of a second (S) phase source voltage by the second voltage measuring transformer after the energizing of the first (R) phase, and a third command for energizing the third (T) phase at the predetermined electrical phase angle of the third (T) phase in response to detection of a zero point of a third (T) phase source voltage at a time around ⅓ of a cycle after an energizing time of the second (S) phase.

A tenth embodiment of the present invention provides a synchronous switching apparatus similar to that of the first embodiment for use with an impedance load in the form of a three-phase core transformer or shunt reactor having star-connected windings with a neutral point ungrounded, or a single-phase core and three-phase core delta connection transformer or shunt reactor. The plurality of phase-to-phase voltage measuring transformers includes a first-to-second (R-to-S phase) and a third-to-first (T-to-R) phase voltage measuring transformer, which measure a first-to-second and a third-to-first phase voltage, respectively. The predetermined electrical phase angles of the first-to-second and third-to-first phase voltages are within a range of 90 degrees ±20 degrees and 60 degrees ±20 degrees, respectively.

The impedance load is energized with a source voltage via a command sequence, wherein the phase control devices respectively issue a first command for energizing the second (S) phase at any time, a second command for energizing the first (R) phase at the predetermined electrical phase angle of a first-to-second (R-to-S) phase voltage in response to detection of a zero point of a first-to-second (R-to-S) phase voltage by the first-to-second phase voltage measuring transformer after an energizing time of the second (S) phase, and a third command for energizing the third (T) phase at the predetermined electrical phase angle of a third-to-first (T-to-R) phase voltage in response to detection of a zero point of a third-to-first (T-to-R) phase voltage by the third-to-first phase voltage measuring transformer at a time around ⅓ of a cycle after an energizing time of the first (R) phase.

An eleventh embodiment of the present invention provides a synchronous switching apparatus similar to that of the first embodiment for use with an impedance load in the form of a three-phase core transformer or shunt reactor having star-connected windings with a neutral point ungrounded, or a single-phase core and three-phase core delta connection transformer or shunt reactor. The plurality of phase-to-phase voltage measuring transformers includes a second-to-third (S-to-T) and a third-to-first (T-to-R) phase voltage measuring transformer, which measure a second-to-third and a third-to-first phase voltage, respectively. The predetermined electrical phase angles of the second-to-third and the third-to-first phase voltages are within a range of −150 degrees ±20 degrees and 60 degrees ±20 degrees, respectively.

The impedance load is energized with a source voltage via a command sequence, wherein the phase control devices respectively issue a first command for energizing the first (R) phase at any time, a second command for energizing the second (S) phase at the predetermined electrical phase angle of a second-to-third (S-to-T) phase voltage in response to detection of a zero point of a second-to-third (S-to-T) phase voltage by the second-to-third phase voltage measuring transformer after an energizing of the first (R) phase, and a third command for energizing the third (T) phase at the predetermined electrical phase angle of a third-to-first (T-to-R) phase voltage in response to detection of a zero point of a third-to-first (T-to-R) phase voltage by the third-to-first phase voltage measuring transformer at a time around ⅓ of a cycle after an energizing time of the second (S) phase.

A twelfth embodiment of the present invention provides a synchronous switching apparatus similar to that of the second embodiment, but which is for use with an impedance load in the form of capacitor banks with a neutral point grounded or transmission lines without an electric charge. In addition, the predetermined electrical phase angles of each of the first, second, and third phases are within a range of 0 degrees (zero voltage points of the R, S, and T phases) ±20 degrees.

A thirteenth embodiment of the present invention provides a synchronous switching apparatus similar to that of the third embodiment, but which is for use with an impedance load in the form of capacitor banks with a neutral point grounded or transmission lines without an electrical charge. In addition, the predetermined electrical phase angles of each of the first-to-second phase voltage, the second-to-third phase voltage, and the third-to-first phase voltage are within a range of −30 degrees ±20 degrees.

A fourteenth embodiment of the present invention provides a synchronous switching apparatus similar to that of the first embodiment for use with an impedance load in the form of capacitor banks with a neutral point ungrounded. The plurality of voltage measuring transformers includes a second and a third voltage measuring transformer, which measure source voltages of the second and third phases, respectively. The predetermined electrical phase angles of the second and third phases are within a range of 0 degrees ±20 degrees and 30 degrees ±20 degrees, respectively.

The impedance load is energized with a source voltage via a command sequence, wherein the phase control devices respectively issue a first command for energizing the first (R) phase at any time, a second command for energizing the third (T) phase at the predetermined electrical phase angle of the third (T) phase in response to detection of a zero point of the third (T) phase source voltage by the third voltage measuring transformer after an energizing of the first (R) phase, and a third command for energizing the second (S) phase at the predetermined electrical phase angle of the second (S) phase in response to detection of a zero point of a second (S) phase source voltage by the second voltage measuring transformer at a time around ¼ of a cycle after an energizing time of the third (T) phase.

A fifteenth embodiment of the present invention provides a synchronous switching apparatus similar to that of the eighth embodiment, but which is for use with an impedance load in the form of capacitor banks with a neutral point ungrounded. In addition, the predetermined electrical phase angle of the first phase is within a range of 30 degrees ±20 degrees, and the predetermined electrical phase angle of the third phase is within a range of 0 degrees ±20 degrees. Also, the respective phase control device issues the third command for energizing the third (T) phase at the predetermined electrical phase angle of the third (T) phase in response to detection of a zero point of a third (T) phase source voltage by the third voltage measuring transformer at a time around ¼ of a cycle after a energizing time of the first (R) phase.

A sixteenth embodiment of the present invention provides a synchronous switching apparatus similar to that of the first embodiment for use with an impedance load in the form of capacitor banks with a neutral point ungrounded. The plurality of voltage measuring transformers includes a first and a third voltage measuring transformer, which measure source voltages of the first and third phases, respectively. The predetermined electrical phase angles of the first and third phases are within a range of 30 degrees ±20 degrees and 0 degrees ±20 degrees, respectively.

The impedance load is energized with a source voltage via a command sequence, wherein the phase control devices respectively issue a first command for energizing the second (S) phase at any time, a second command for energizing the first (R) phase at the predetermined electrical phase angle of the first (R) phase in response to detection of a zero point of a first (R) phase source voltage by the first voltage measuring transformer after the energizing of the second (S) phase, and a third command for energizing the third (T) phase at the predetermined electrical phase angle of the third (T) phase in response to detection of a zero point of a third (T) phase source voltage by the third voltage measuring transformer at a time around ¼ of a cycle after a energizing time of the first (R) phase.

A seventeenth embodiment of the present invention provides a synchronous switching apparatus similar to that of the first embodiment for use with an impedance load in the form of capacitor banks with a neutral point ungrounded. The plurality of phase-to-phase voltage measuring transformers includes a second-to-third (S-to-T) and a third-to-first (T-to-R) phase voltage measuring transformer, which measure a second-to-third and a third-to-first phase voltage, respectively. The predetermined electrical phase angles of the second-to-third and the third-to-first phase voltages are within a range of −30 degrees ±20 degrees and 0 degrees ±20 degrees, respectively.

The impedance load is energized with a source voltage via a command sequence, wherein the phase control devices respectively issue a first command for energizing the first (R) phase at any time, a second command for energizing the third (T) phase at the predetermined electrical phase angle of a third-to-first (T-to-R) phase voltage in response to detection of a zero point of a third-to-first (T-to-R) phase voltage by the third-to-first phase voltage measuring transformer after the energizing of a first (R) phase, and a third command for energizing the second (S) phase at the predetermined electrical phase angle of a second-to-third (S-to-T) phase voltage in response to detection of a zero point of a second-to-third (S-to-T) phase voltage by the second-to-third phase voltage measuring transformer at a time around ¼ of a cycle after an energizing time of the third (T) phase.

An eighteenth embodiment of the present invention provides a synchronous switching apparatus similar to that of the tenth embodiment, but which is for use with an impedance load in the form of capacitor banks with a neutral point ungrounded. In addition, the predetermined electrical phase angle of the first-to-second phase voltage is within a range of 0 degrees ±20 degrees, and the predetermined electrical phase angle of the third-to-first phase voltage is within a range of −30 degrees ±20 degrees. Also, the respective phase control device issues the third command for energizing the third (T) phase at the predetermined electrical phase angle of the third-to-first (T-to-R) phase voltage in response to detection of a zero point of a third-to-first (T-to-R) phase voltage by the third-to-first phase voltage measuring transformer at a time around ¼ of a cycle after a energizing time of the first (R) phase.

A nineteenth embodiment of the present invention provides a synchronous switching apparatus similar to that of the first embodiment for use with an impedance load in the form of capacitor banks with a neutral point ungrounded. The plurality of phase-to-phase voltage measuring transformers comprises a first-to-second (R-to-S) and a second-to-third (S-to-T) phase voltage measuring transformer, which measure a first-to-second and a second-to-third phase voltage, respectively. The predetermined electrical phase angles of the first-to-second and the second-to-third phase voltages are within a range of −30 degrees ±20 degrees and 0 degrees ±20 degrees, respectively.

The impedance load is energized with a source voltage via a command sequence, wherein the phase control devices respectively issue a first command for energizing the third (T) phase, a second command for energizing the second (S) phase at the predetermined electrical phase angle of a second-to-third (S-to-T) phase voltage in response to detection of a zero point of a second-to-third (S-to-T) phase voltage by the second-to-third phase voltage measuring transformer after the energizing of the third (T) phase, and a third command for energizing the first (R) phase at the predetermined electrical phase angle of a first-to-second (R-to-S) phase voltage in response to detection of a zero point of a first-to-second (R-to-S) phase voltage by the first-to-second phase voltage measuring transformer at a time around ¼ of a cycle after an energizing time of the second (S) phase.

A twentieth embodiment of the present invention provides a synchronous switching apparatus similar to that of the first embodiment, but further includes surge absorbers, which are provided between respective phases and ground, for respectively suppressing surge voltages of respective phases. In addition, surge absorbers are provided between respective phases for suppressing phase-to-phase surge voltages.

BEST MODE FOR CARRYING OUT THE INVENTION

Embodiment 1

Figure 1:
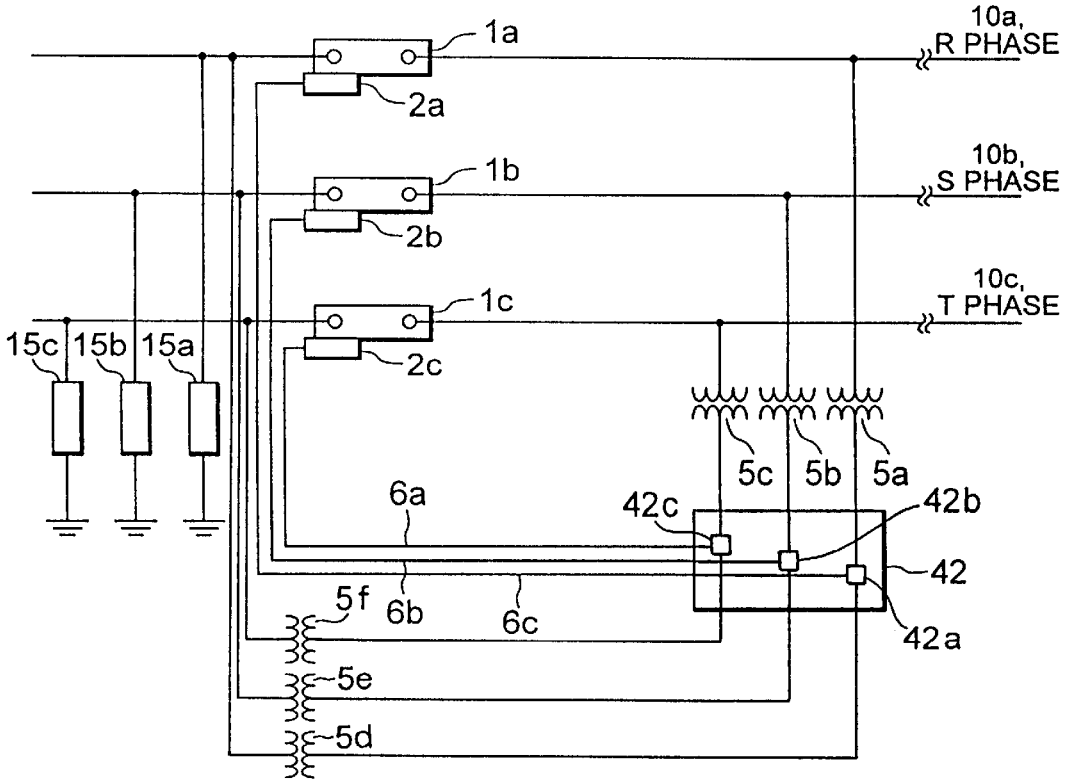
FIG. 1 is a block diagram of a synchronous switching apparatus according to an embodiment of the invention.
Figure 2:
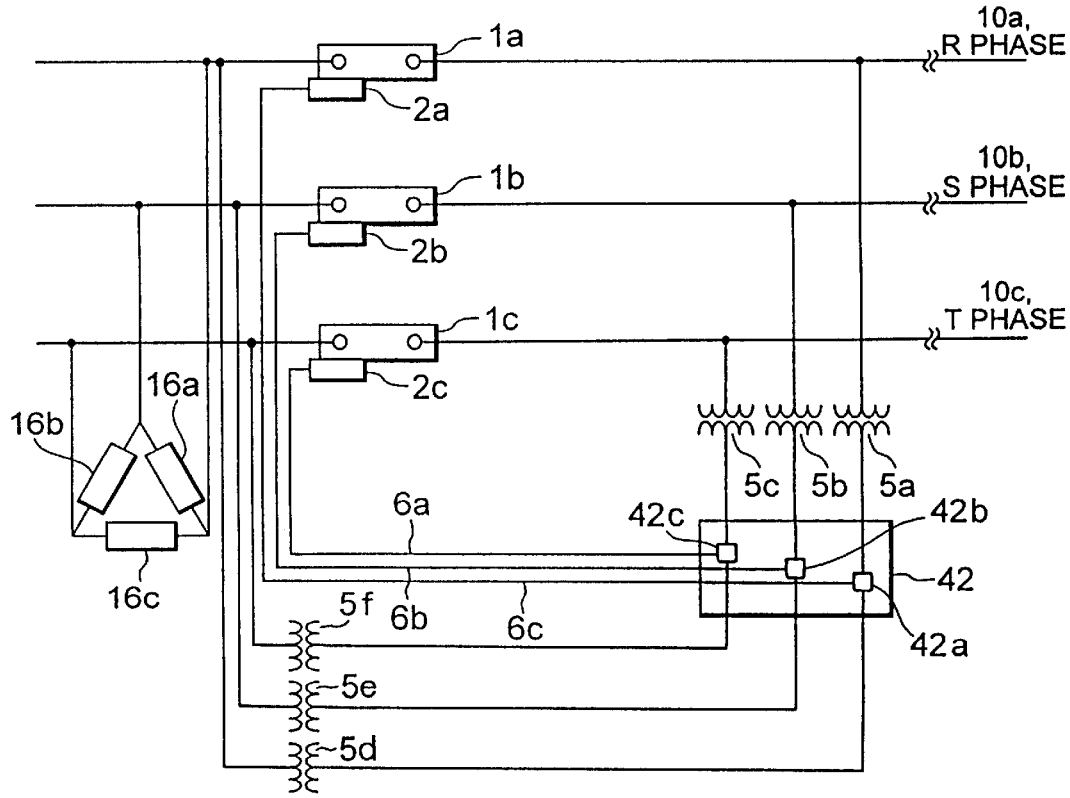
FIG. 2 is a block diagram of a synchronous switching apparatus according to another embodiment of the invention.
Figure 3:
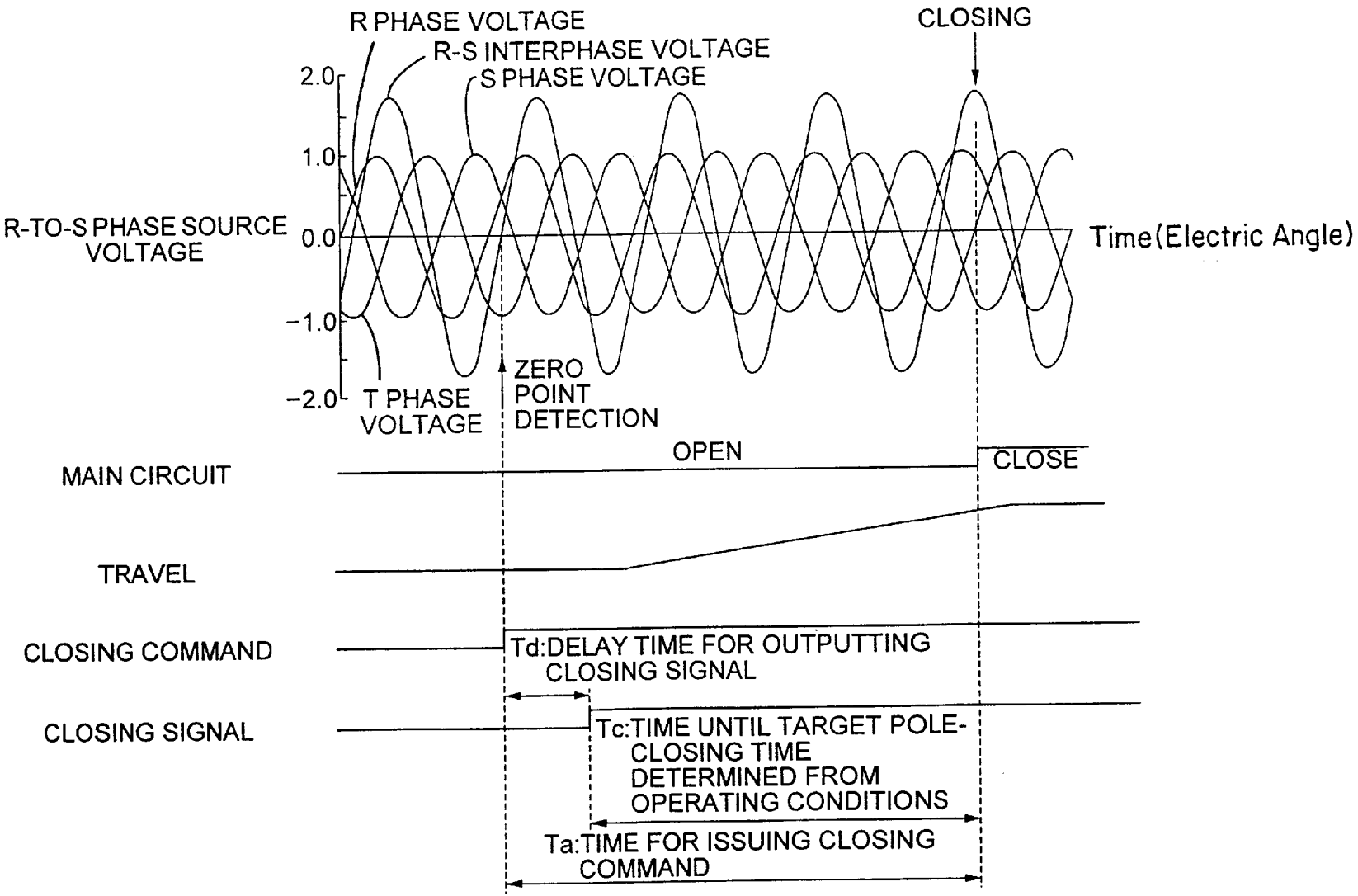
FIG. 3 is a view for illustrating the operating sequence of the synchronous switching apparatus of the invention.

FIGS. 1 to 3 illustrate a synchronous switching apparatus of the present invention and its operating sequences. In FIG. 1, (1*a*), (1*b*) and (1*c*) are synchronous switching devices provided for R, S and T phases, respectively; (2*a*), (2*b*) and (2*c*) are switching mechanisms for closing and opening the switching devices for R, S and T phases, respectively; (5*a*), (5*b*) and (5*c*) are measuring transformers (voltage measuring transformers) used for measuring the source voltage of the R, S and T phases, respectively; (5*d*), (5*e*) and (5*f*) are measuring transformers (phase-to-phase voltage measuring transformers) used for measuring R-to-S, S-to-T and T-to-R phase voltage, respectively; (42) is a phase control device for detecting the zero points of the source voltage of the R, S and T phases as well as the zero points of the R-to-S, S-to-T and T-to-R phase voltage, and for issuing a closing command to the switch mechanisms (2) of the switching device (1) through signal transmission cable (6); (15*a*), (15*b*) and (15*c*) are surge absorbers provided between each of buses (10*a*), (10*b*) and (10*c*), respectively, of the R, S and T phases and ground for suppressing surges, respectively; (16*a*), (16*b*) and (16*c*) are surge absorbers for suppressing R-to-S, S-to-T and T-to-R phase surges, respectively.

When system equipment is energized using the synchronous switching apparatus configured in this way, first, the transformer (5*a*), (5*b*) and (5*c*) for detecting the source voltage of R, S and T phases, respectively, detects the zero points of the source voltage of R, S and T phases, respectively. At the same time, the measuring transformers (5*d*), (5*e*) and (5*f*) for measuring R-to-S, S-to-T and T-to-R phase voltage respectively, detect the zero voltage points of the R-to-S, S-to-T and T-to-R phase voltage respectively. The phase control device 42 estimates "a pole-closing time Td" which is the time until an electrical phase angle of a certain ideal angular phase is reached based on the operating time as determined from the temperature, operating voltages and past operating history adjusts "the delay time Td" for outputting a closing signal such that closing may be established at a closing time Ta corresponding to the target electrical phase angle of each R, S and T phase voltage, and outputs the closing command.

Alternatively, as shown in the operating sequence of FIG. 3, the phase control device 42 provides closing commands to the switching mechanism (2*a*), (2*b*) and (2*c*) such that closing may be established at the closing time Ta corresponding to the target electrical-phase-angle of each R-to-S, S-to-T and T-to-R phase voltage. Accordingly, when each phase is energized at the predetermined energizing time, switching equipment is closed for the transformer (3), so that transient phenomena can be suppressed. Ideal energizing timing for system equipment such as transformer and shunt reactor is at the peak voltages or zero voltage of each phase-to-phase voltage, but not at an intermediate electrical phase angle of the source voltage of each of the phases. Therefore, more accurate closing can be realized by detecting not only the zero voltage point of the source voltage of each of the R, S and T phases but also the zero voltage point of each of the R-to-S, S-to-T and T-to-R phase voltage to determine the closing time.

Therefore, when transient phenomena are caused by the operation of other switching equipment, a detected zero point of each phase voltage or each phase-to-phase voltage may deriate. Therefore, surge absorbers (15) provided between the bus lines of the R, S and T phases and ground for suppressing over voltages and the surge absorbers (16) for suppressing R-to-S, S-to-T and T-to-R phase overvoltage suppress transient phenomena so as to minimize voltage disturbances in each of the R, S, and T phase voltage and in each of the R-to-S, S-to-T and T-to-R phase voltage. This reduces errors in zero point detection to a minimum. Also, because the closing time of switching equipment inevitably varies due to the mechanical characteristics of the switching equipment and the occurrence of discharge, ideal closing is not always realized.

These variations in closing time are on the order of ±0.5 ms in switching devices with high closing speed, and on the order of ±1.0 ms in switching devices with low closing speed. The closing time variations of ±0.5 ms and ±1.0 ms correspond to ±10 degrees and ±20 degrees in commercial frequencies, respectively. Actually, when the real energizing timing for system equipment such as transformer and shunt reactor deviates from an ideal closing phase angle by the order of ±110 degrees (about ±0.5 ms from the ideal closing time), the surge voltage and exciting inrush current may rise up to about the surge level which can be suppressed by the switching device of the resistor insertion system and this level may be practically used.

Therefore, the invention can provide a switching apparatus wherein variations in closing time can be controlled to less than 10 degrees (less than ±0.5 ms from a predetermined closing time). When the invention is applied to a switching apparatus with low closing speed, the real closing can deviate from the ideal closing phase angle by about ±20 degrees (about ±1.0 ms from the ideal closing time). Then, the surge voltage or exciting inrush current generated may be, at maximum, half of the surge level caused by the switching devices in which the closing phases are not controlled.

Embodiment 2

Figure 4:
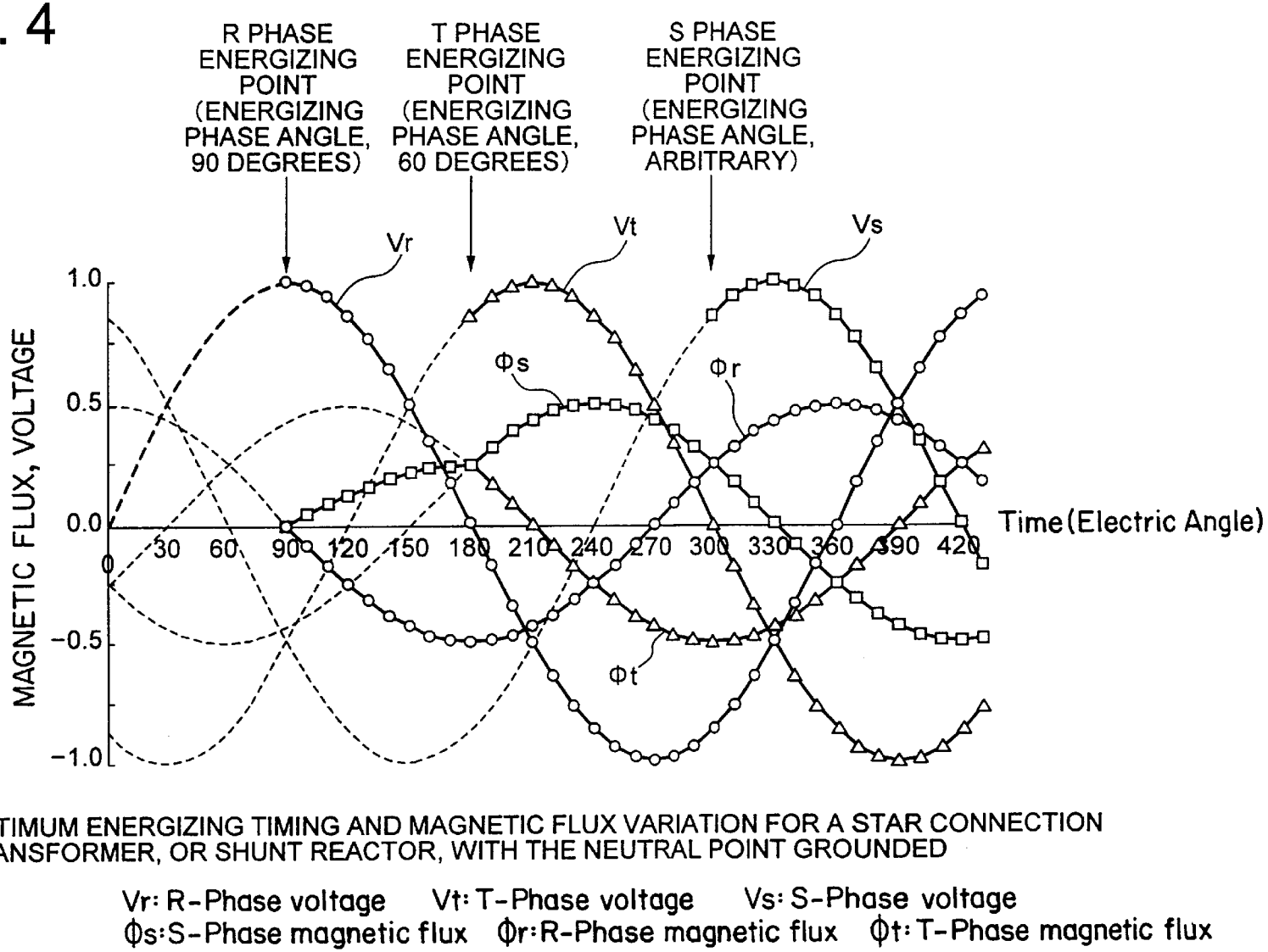
FIG. 4 is a view for illustrating the optimum closing timing and magnetic flux variation for a star connection transformer, or shunt reactor, with a neutral point grounded.

More specifically, in the method for detecting each phase voltage according to a second embodiment of the present invention, in the case where a single-phase core transformer or shunt reactor is energized with a source voltage, as shown in FIG. 4, first, when the voltage measuring transformer (5*a*) detects the zero voltage point of a first phases (R phase) source voltage, the phase control device 42 operates the switching mechanisms 2*a* to close the switching device 1*a*, so that the first phase (R phase) is energized at an electrical phase angle of the first phase (R phase) within the 70-to-110 degree range, preferably within the 80-to-100 degree range. At this timing, the exciting inrush current of the first phase (R phase) can be suppressed because the magnetic flux generated in R phase is steady and hence transient phenomena can not occur. Then, when the voltage measuring transformer 5*c* detects the zero voltage point of a third phase (T phase) source voltage at a time ⅓ of a cycle after an energizing time of the first phase (R phase), the phase control device 42 operates the switching mechanisms 2*c* to close the switching device 1*c*, and then the third phase (T phase) is energized at an electrical phase angle of the third phase (T phase) within the 70-to-110 degree range, preferably within the 80-to-100 degree range.

At this timing, the exciting inrush current of the third phase (T phase) can be suppressed because the magnetic flux generated in T phase is in a steady state and hence transient phenomena can not occur. Finally, when the voltage measuring transformer 5*b* detects the zero voltage point of a second phase (S phase) source voltage at a time ⅓ of a cycle after an energizing time of the third phase (T phase), the phase control device 42 operates the switching mechanisms 2*b* to close the switching device 1*b*, so that the second phase (T phase) is energized at an electrical phase angle of the second phase (S phase) within the 70-to-110 degree range, preferably within the 80-to-100 degree range. At this timing, the exciting inrush current of the third phase (T phase) can be suppressed, because the magnetic fluxes generated in S phase are in a steady state and so transient phenomena can not occur.

In the following embodiments, in the energizing operations of the first phase (R) to the third phase (T), the measuring transformer 5*a*, 5*b*, and 5*c*, phase control device 42, switching devices 2*a*, 2*b*, and 2*c*, and switching devices 1*a*, 1*b*, and 1*c* operate in the same manner as in embodiment 2.

Embodiment 3

With the synchronous switching apparatus of this embodiment according to a third embodiment of the present invention, similarly, in the method for detecting phase-to-phase voltage, when a single-phase core transformer or shunt reactor is energized with a source voltage, first, the zero point of a first-to-second phase (R-to-S phase) voltage is detected, so that the first phase (R phase) is energized at an electrical phase angle of the first-to-second phase (R-to-S phase) voltage within the 40-to-80 degree range, preferably within the 50-to-70 degree range. Thereby, transient phenomena can be suppressed and the exciting inrush current of the first phase (R phase) can also be suppressed.

Next, the zero point of the third-to-first phase (T-to-R phase) voltage is detected at a time ⅓ of a cycle after an energizing time of the first phase (R phase), and the third phase (T phase) is energized at an electrical phase angle of the third-to-first phase (T-to-R phase) voltage within the 40-to-80 degree range, preferably within the 50-to-70 degree range. Finally, the zero point of the second-to-third phase (S-to-T phase) voltages is detected at a time ⅓ of a cycle after an energizing time of the third phase (T phase), and the second phase (S phase) is energized at an electrical phase angle of the second-to-third phase (S-to-T phase) voltage within the 40-to-80 degree range, preferably within the 50-to-70 degree range.

Embodiment 4

Using the synchronous switching apparatus of this embodiment according to a fourth embodiment of the present invention, by the method of detecting each phase voltage, where a three phase core transformer or shunt reactor having star connected windings with a neutral point grounded is energized with a source voltage, first, the zero point of the first phase (R phase) source voltage is detected, so that the first phase (R phase) is energized at an electrical phase angle of the first phase (R phase) within the 70-to-110 degree range, preferably within the 80-to-100 degree range.

Accordingly, the transient phenomena can be suppressed and the exciting inrush current of the first (R phase) can also be suppressed. Subsequently, the zero point of the third phase (T phase) source voltage is detected at a time ¼ of a cycle after an energizing time of the first phase (R phase), so that the third phase (T phase) is energized at an electrical phase angle of the third phase (T phase) within the 40-to-80 degree range, preferably within the 50-to-70 degree range. At this timing, the magnetic fluxes of the S and T phases (half the magnetic flux of the R phase and having an opposite sign), generated by the current flowing in the S and T phases produced by the magnetic flux of the R phase which is energized first, are equal to the steady state magnetic flux generated in the T phase when the T phase is energized. Therefore, the transient phenomena can be suppressed and the exciting inrush current of the third phase (T phase) can also be suppressed.

Figure 5:
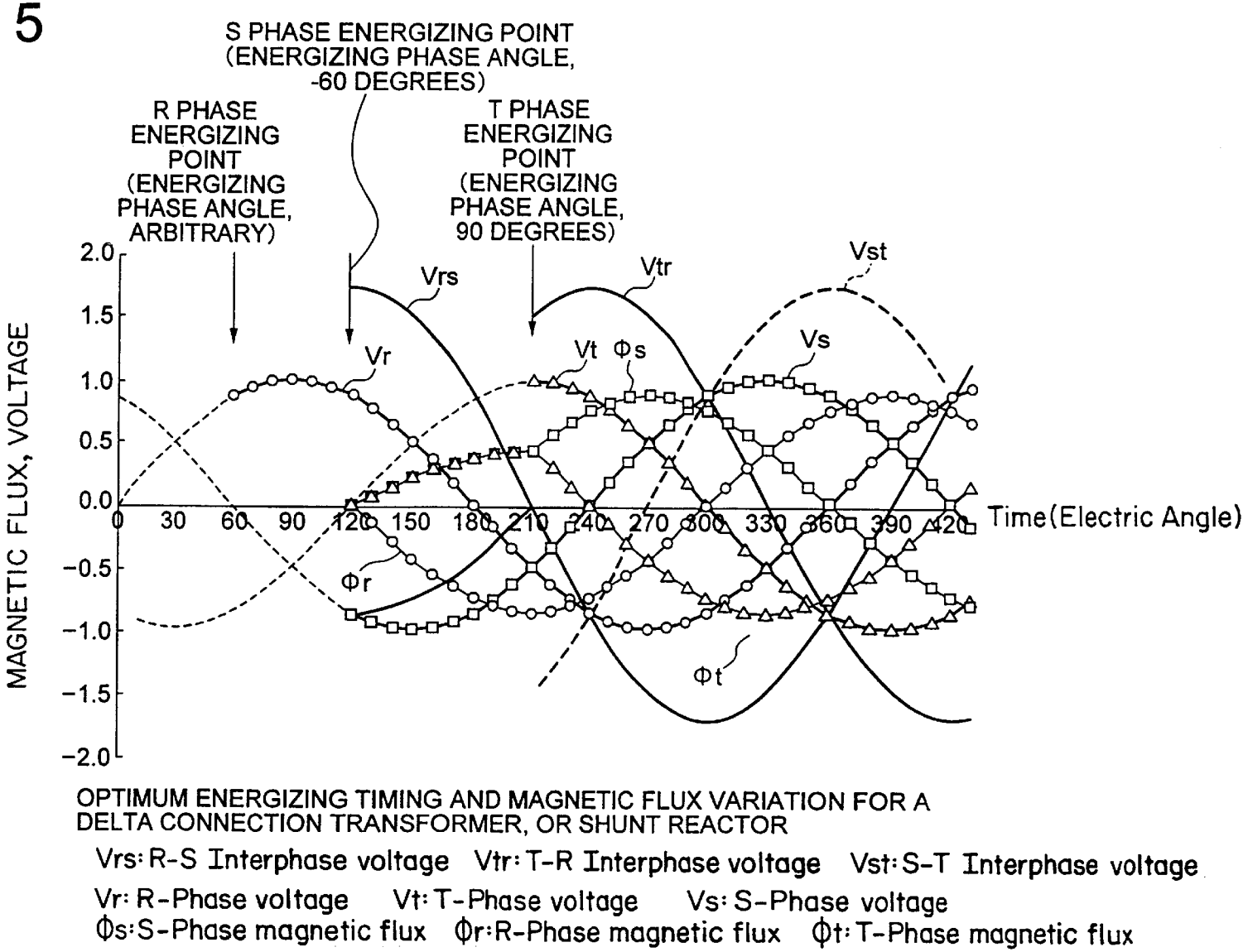
FIG. 5 is a view for illustrating the optimum energizing timing and the magnetic flux variation of a delta connection transformer, or a star connection transformer of a shunt reactor, or a shunt reactor.
Figure 6:
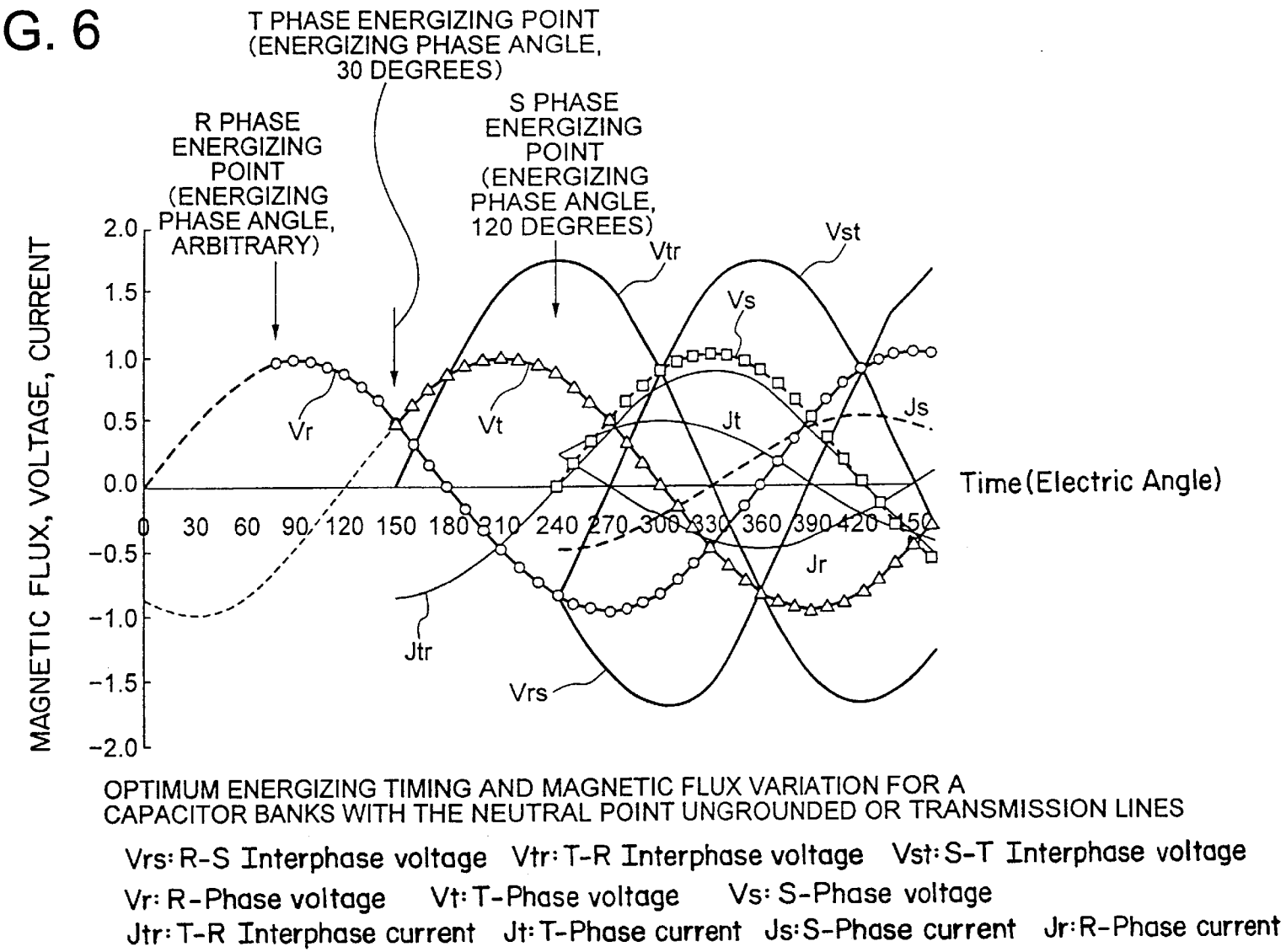
FIG. 6 is a view for illustrating the optimum energizing timing and magnetic flux variation for ungrounded capacitor banks or transmission lines.
Figure 7:
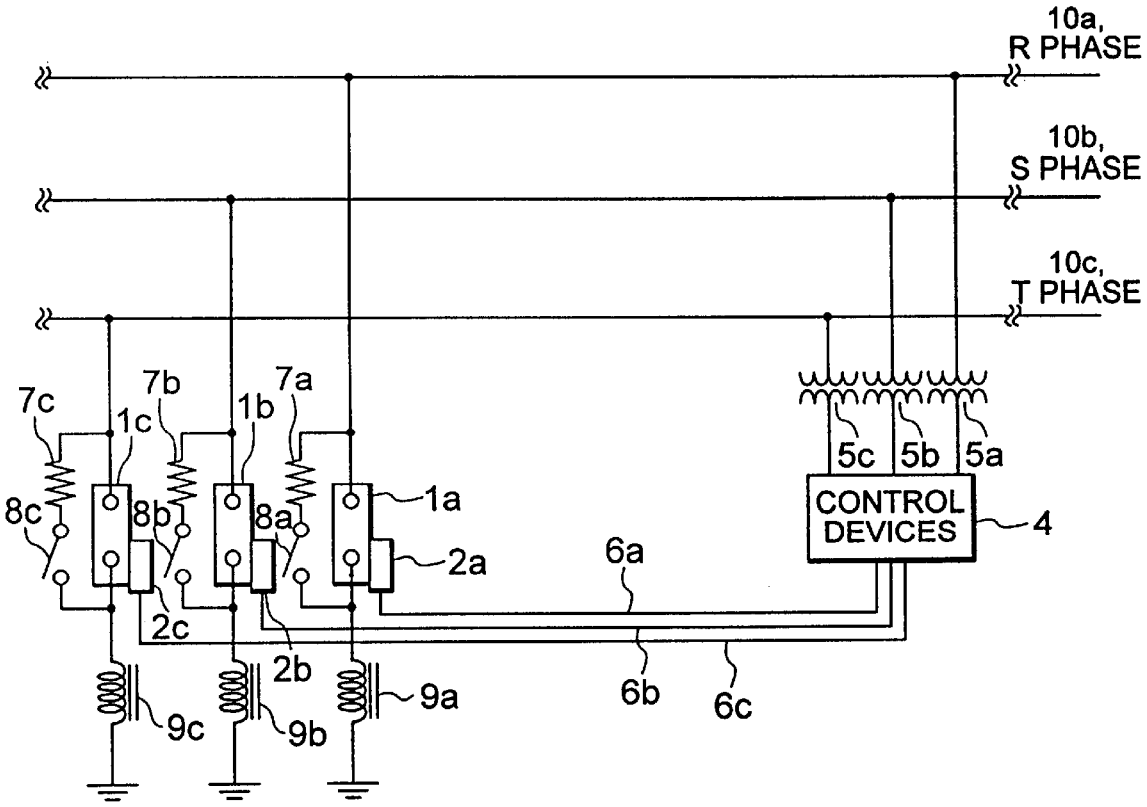
FIG. 7 PRIOR ART
FIG. 7 is a block diagram of a conventional synchronous switching apparatus using the resistor insertion method.
Figure 8:
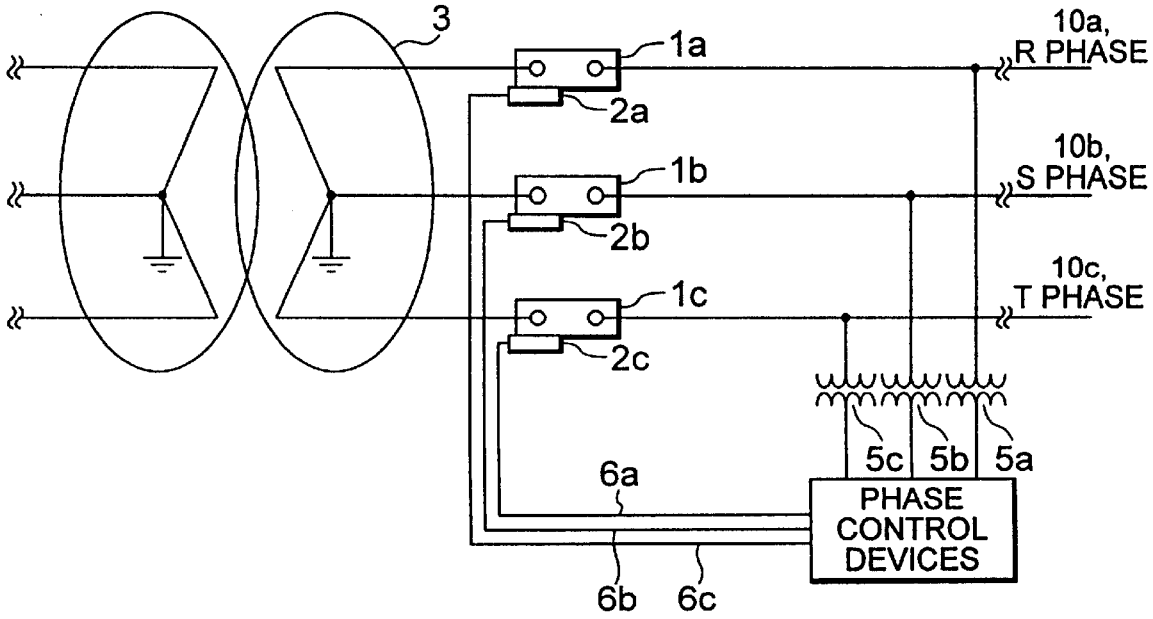
FIG. 8 PRIOR ART
FIG. 8 is a block diagram of a conventional synchronous switching apparatus.
Figure 9:
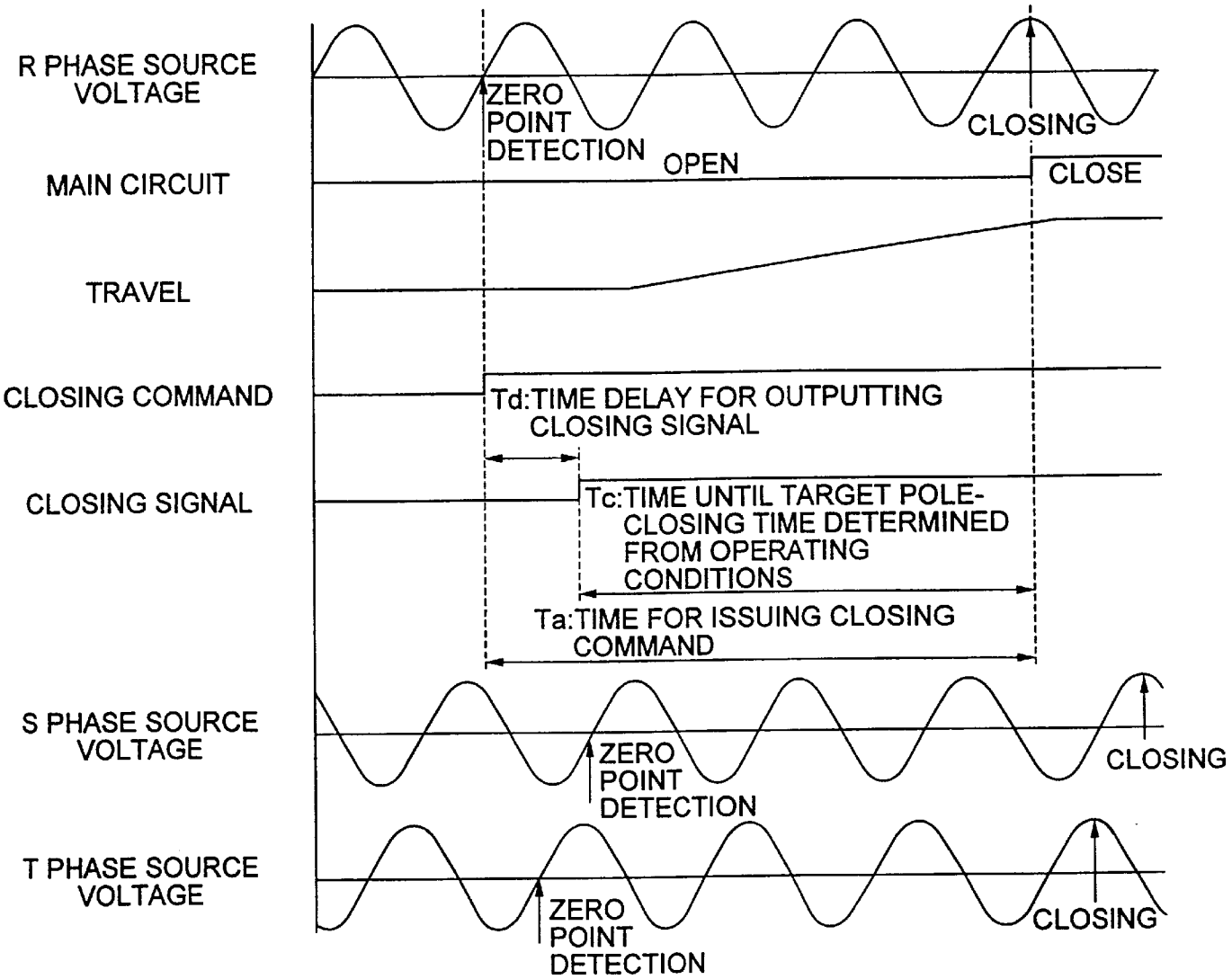
FIG. 9 PRIOR ART
FIG. 9 is a view for illustrating the operating sequence of the conventional synchronous switching apparatus.
Figure 10:
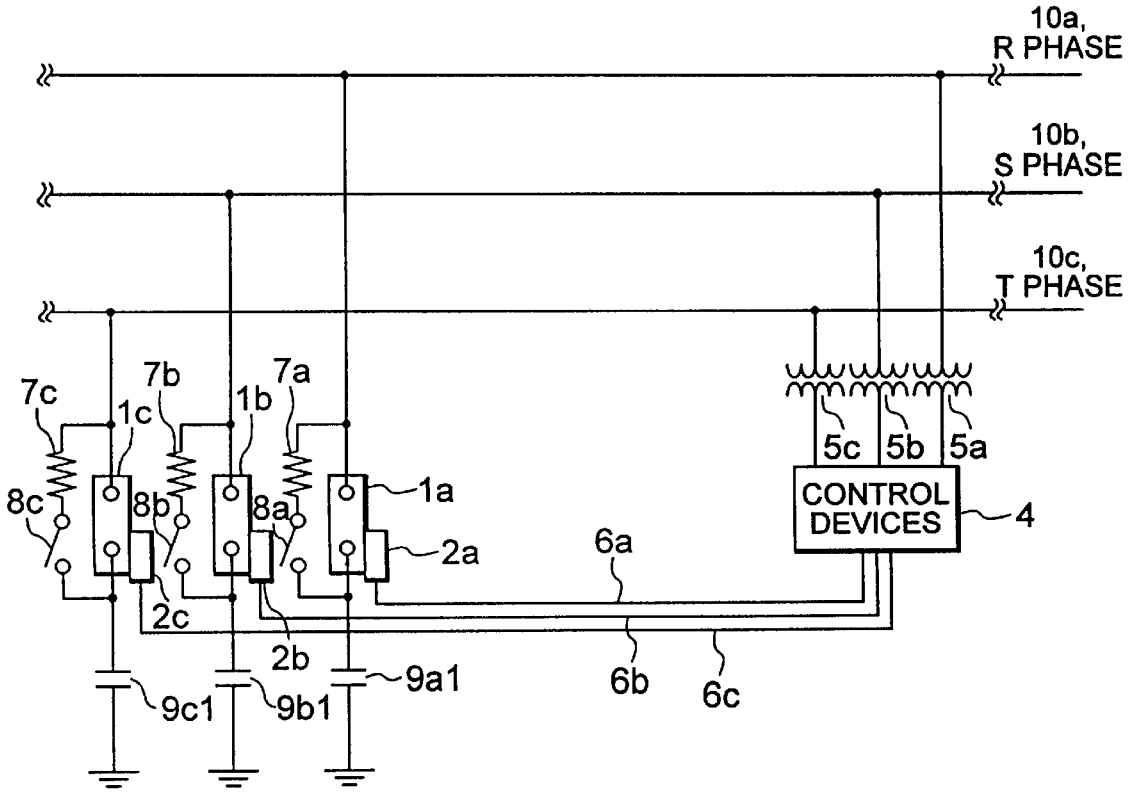
FIG. 10 PRIOR ART
FIG. 10 is a block diagram of a conventional switching device using the resistor insertion method.
Figure 11:
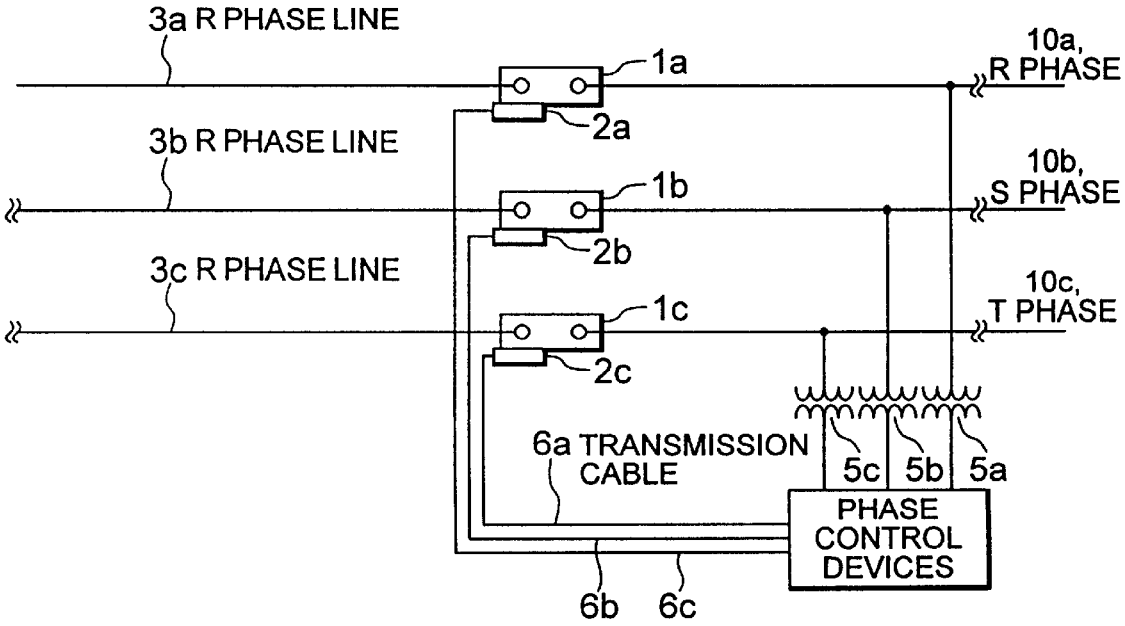
FIG. 11 PRIOR ART
FIG. 11 is a block diagram of a conventional synchronous switching apparatus.
Figure 12:
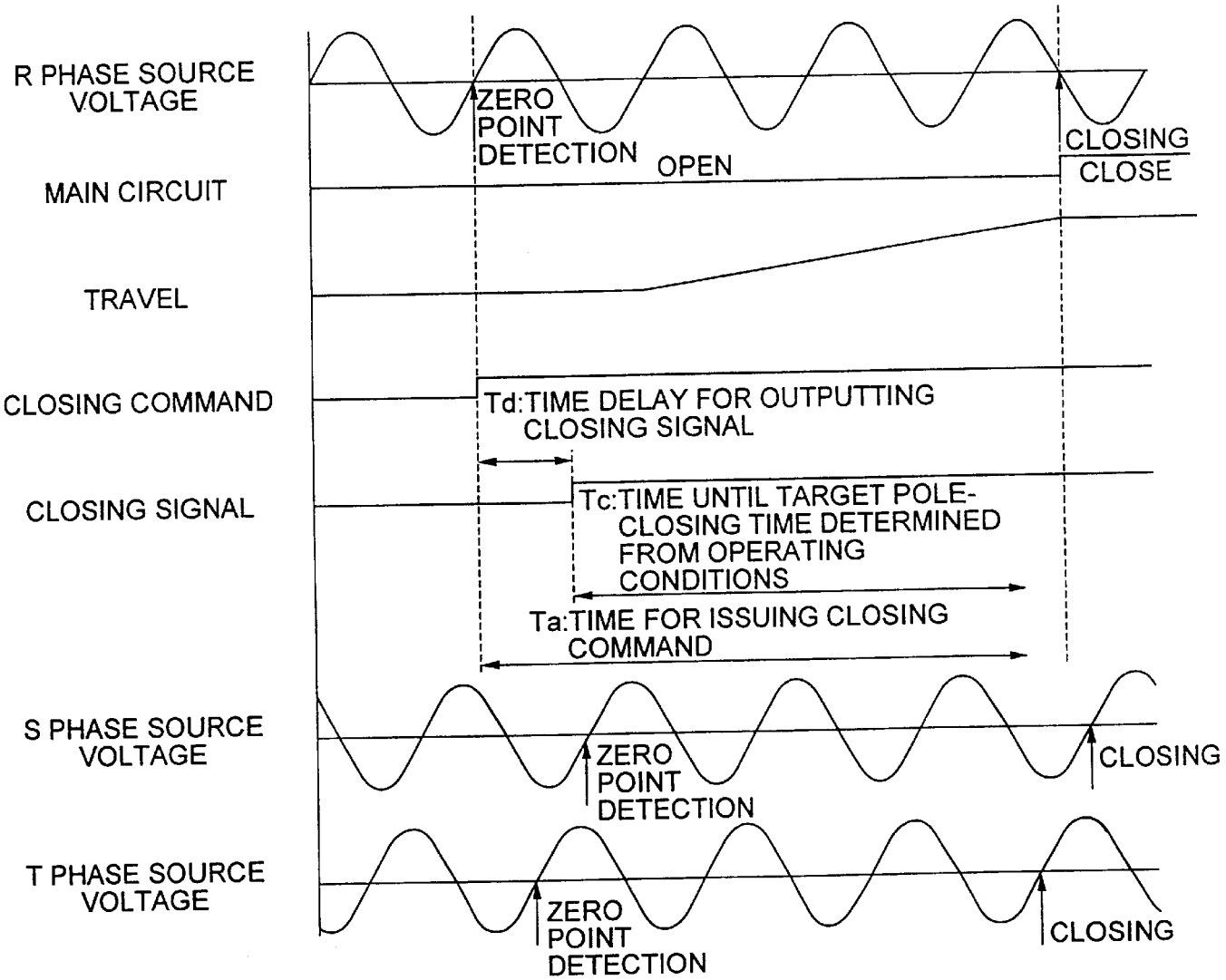
FIG. 12 PRIOR ART
FIG. 12 is a view for illustrating the operating sequence of the conventional synchronous switching apparatus.

The voltage of each phase at this time and the flux of each phase after energizing are shown in FIG. 5. Finally, at any time after the third phase (T phase) is energized, the second phase (S phase) is energized. It is one of the features of the invention that this 3rd energization can be performed at any time. Because, the magnetic flux of the S phase, which is generated by the current flowing in the S phase created by the magnetic flux produced in the R and T phases, is made equal to the steady state magnetic flux generated in the S phase when the S phase is energized, no matter what any time the energizing of the S phase is performed, both the transient phenomena and the exciting inrush current of the second phase (S phase) can be suppressed. Generally, the energization is set at an electrical phase angle of the S phase near 0–120 degrees where discharge is unlikely.

Embodiment 5

Using the synchronous switching apparatus of this embodiment according to a fifth embodiment of the present invention, by the method of detecting each phase voltage, when in another case a three phase core transformer or shunt reactor having star connected windings with a neutral point grounded is energized with a source voltage first, the zero point of the first phase (R phase) source voltage is detected, so that the first phase (R phase) is energized at an electrical phase angle of the first phase (R phase) within the 70-to-110 degree range, preferably within a 80-to-100 degree range.

Accordingly, transient phenomena can be suppressed and the exciting inrush current of the first phase (R phase) can also be suppressed.

Subsequently, the zero point of the second phase (S phase) source voltage is detected at a time ¼ of a cycle after an energizing time of the first phase (R phase), so that the second phase (S phase) is energized at an electrical phase angle of the second phase (S phase) within the range of from −50 to −20 degrees, preferably within the range of from −40 to −20 degrees. At this timing, the magnetic fluxes of the S and T phases (half of the magnetic flux of the R phase and opposite sign), generated by the currents flowing in the S and T phases produced by the magnetic flux created in the R phase first energized are equal to the steady state magnetic flux generated in the S phase when the S phase is energized. Therefore, the transient phenomena can be suppressed and the exciting inrush current of the second phase (S phase) can also be suppressed.

Finally, at any time after the energizing of the second phase (S phase), the third phase (T phase) is energized. As already described, it is one of the features of the invention that this third energization can be performed at any time. Because, the magnetic flux of the T phase, generated by the current flowing in the T phase created by the magnetic fluxes produced in the R and S phases, is equal to the steady state magnetic flux generated in the T phase when the T phase is energized. Therefore, even if the energizing of the T phase is done at any timing, transient phenomena can be suppressed and the exciting inrush current of the third phase (T phase) can also be suppressed.

Embodiment 6

Using the synchronous switching apparatus of this embodiment according to a sixth embodiment of the present invention, by the method of detecting each phase-to-phase voltage, where a three phase core transformer or shunt reactor having star connected windings with a neutral point grounded is energized with a source voltage first, the zero point of the first-to-second phase (R-to-S phase) voltage is detected, so that the first phase (R phase) is energized at an electrical phase angle of the first-to-second phase (R-to-S phase) voltage within the 40-to-80 degree range, preferably within the 50-to-70 degree range. Accordingly, transient phenomena can be suppressed and the exciting inrush current of the first phase (R phase) can also be suppressed.

Subsequently, the zero point of the third-to-first phase (T-to-R phase) voltage is detected at a time ⅓ of a cycle after an energizing time of the first phase (R phase), so that the third phase (T phase) is energized at an electrical phase angle of the third-to-first phase (T-to-R phase) voltage within the 10-to-50 degree range, preferably within the 20-to-40 degree range. Finally, the second phase (S phase) is energized at any time after the energizing of the third phase (T phase).

Embodiment 7

Using the synchronous switching apparatus of this embodiment according to a seventh embodiment of the present invention, by the method of detecting each phase-to-phase voltage, when a three phase core transformer or shunt reactor having star connected windings with a neutral point grounded is energized with a source voltage first, the zero point of the first-to-second phase (R-to-S phase) voltage is detected, so that the first phase (R phase) is energized at an electrical phase angle of the first-to-second phase (R-to-S phase) voltage within the 40-to-80 degree range, preferably within the 50-to-70 degree range. Accordingly, transient phenomena can be suppressed and the exciting inrush current of the first phase (R phase) can also be suppressed.

Subsequently, the zero point of the second-to-third phase (S-to-T phase) voltage is detected at a time ⅓ of a cycle after an energizing time of the first phase (R phase), so that the second phase (S phase) is energized at an electrical phase angle of the second-to-third phase (S-to-T phase) voltage within the range of from −80 to −40 degrees, preferably within the range of from −70 to −50 degrees. Finally, the second phase (S phase) is energized at any time after the energizing of the third phase (T phase).

Embodiment 8

Using the synchronous switching apparatus of this embodiment according to an eighth embodiment of the present invention, by the method of detecting each phase voltage, when three phase core transformer or shunt reactor having star connected windings with a neutral point ungrounded, or a single phase or three phase core delta connection transformer or shunt reactor is energized with a source voltage, the second phase (S phase) is energized at any time.

With the neutral point ungrounded, energizing of one phase does not cause transient phenomena because a current path is not formed between the phases. Energizing is generally set near an electrical phase angle of the 0-to-120 degree range in which it is difficult for discharge to occur. Then, after the energizing of the second phase (S phase), the zero point of the first phase (R phase) source voltage is detected, so that first phase (R phase) is energized at an electrical phase angle of the first phase (R phase) within the 100-to-140 degree range, preferably within the 110-to-130 degree range. Although a current path is formed between the R and S phases at this time, the R-to-S phase voltage is at its peak at this timing, so the magnetic flux generated in the R phase is in the steady state and transient phenomena do not occur. Finally, the zero point of the third phase (T phase) source voltage is detected at a time ⅓ of a cycle after the energizing time of the first phase (R phase), the third phase (T phase) is energized at an electrical phase angle of the third phase (T phase) within the 70-to-110 degree range, preferably within 80-to-100 degree range. At this timing, the magnetic fluxes of the S and T phases (half the magnetic flux of the R phase and opposite sign), generated by the currents flowing in the S and T phases created by the magnetic flux generated between R and S phases, is made equal to the steady state magnetic flux generated in the T phase when the T phase is energized. Thus, transient phenomena can be suppressed and the exciting inrush current of the third phase (T phase) can be suppressed.

Embodiment 9

Using the synchronous switching apparatus of this embodiment according to a ninth embodiment of the present invention, by the method of detecting each phase voltage, when a three-phase core transformer or shunt reactor having star connected windings with a neutral point ungrounded, or a single-phase and three-phase ore delta connection transformer or shunt reactor is energized with a source voltage, first, the first phase (R phase) is energized at any time. With the neutral point ungrounded, energizing of one phase does not cause transient phenomena because a current path is not formed between the phases.

Energizing is generally set near at an electrical phase angle of the 0-to-120 degree range in which discharge is difficult to occur, as shown in FIG. 4. Then, after the energizing of the first phase (R phase), the zero point of the second phase (S phase) source voltage is detected, and the second phase (S phase) is energized at an electrical phase angle of the second phase (S phase) within the range of from −140 to 100 degrees, preferably within the range of from −130 to −110 degrees. Although a current path is formed between the R and S phases at this time, the R-to-S phase voltage is at its peak at this timing, and so the magnetic flux generated in the R phase is in the steady state and transient phenomena do not occur.

Finally, the zero point of the third phase (T phase) source voltage is detected at a time ⅓ of a cycle after the energizing time of the second phase (S phase), and the third phase (T phase) is energized at an electrical phase angle of the third phase (T phase) within the 70-to-110 degree range, preferably within 80-to-100 degree range. At this timing, the magnetic fluxes of the S and T phases (half the magnetic flux of the R phase and opposite sign), generated by the currents flowing in the S and T phases created by the magnetic flux generated between R and S phases, is made equal to the steady state magnetic flux generated in the T phase when the T phase is energized. Therefore, transient phenomena can be suppressed and the exciting inrush current of the third phase (T phase) can be suppressed.

Embodiment 10

Using the synchronous switching apparatus of this embodiment according to a tenth embodiment of the present invention, by the method of detecting each phase-to-phase voltage, when a three-phase core transformer or shunt reactor having star-connected windings with a neutral point ungrounded, or a single phase and three-phase core delta connection transformer or shunt reactor are energized with a source voltage, first, the second phase (S phase) is energized at any time. Then, after the energizing of the second phase (S phase), the zero point of the first-to-second phase (R-to-S phase) voltage is detected, so that the first phase (R phase) is energized at an electrical phase angle of the first-to-second phase (R-to-S phase) voltage within the 70-to-110 degree range, preferably within the 80-to-100 degree range.

Accordingly, transient phenomena can be suppressed and the exciting inrush current of the first phase (R phase) can be suppressed. Subsequently, the zero point of the third-to-first phase (T-to-R phase) voltage is detected at a time ⅓ of a cycle after the energizing time of the first phase (R phase), so that the third phase (T phase) is energized at an electrical phase angle of the third-to-first phase (T-to-R phase) voltage within the 40-to-80 degree range, preferably within 50-to-70 degree range. At this timing, transient phenomena do not occur in the T phase.

Embodiment 11

Using the synchronous switching apparatus of this embodiment according to an eleventh embodiment of the present invention, by the method of detecting each phase-to-phase voltage, when a three-phase core transformer (or shunt reactor) having star-connected windings with a neutral point ungrounded, or a single-phase and three-phase core delta connection transformer or shunt reactor are energized with a source voltage, first, the first phase (R phase) is energized at any time. Then, after the energizing of the first phase (R phase), the zero point of the second-to-third phase (S-to-T phase) voltage is detected, so that the second phase (S phase) is energized at an electrical phase angle of the second-to-third phase (S-to-T phase) voltage within the range of from −170 to −130 degrees, preferably within the 160-to-140 degree range. Accordingly, transient phenomena can be suppressed and the exciting inrush current of the first phase (R phase) can be suppressed. Subsequently, the zero point of the third-to-first phase (T-to-R phase) voltage is detected at a time ⅓ of a cycle after the energizing time of the first phase (R phase), so that the third phase (T phase) is energized at an electrical phase angle of the third-to-first phase (T-to-R phase) voltage within the 40-to-80 degree range, preferably within the 50-to-70 degree range. At this timing, transient phenomena do not occur in the T phase.

Embodiment 12

Next, the synchronous circuit breaker according to embodiment 12 of the invention and its operation will be explained. The synchronous circuit breaker and its operating sequence of this embodiment are the same as shown in FIGS. 1, 2 and 3 which have been described in the above-mentioned embodiments.

When system equipment is energized by using a synchronous switching apparatus configured in this way, first the transformers (5*a*), (5*b*) and (5*c*) used for detecting the source voltage of R, S and T phases, respectively, detect the zero points of the source voltage of the R, S and T phases. At the same time, the measuring transformers (5*d*), (5*e*) and (5*f*) used for measuring R-to-S, S-to-T and T-to-R phase voltage, respectively and detect the zero voltage points of the R-to-S, S-to-T and T-to-R phase voltage respectively. The phase control device 42 estimates "a pole-closing time Tc" which is the time until an electrical phase angle of a certain ideal angular phase is reached, based on the operating time as determined from the temperature, operating voltages and past operating history, and adjusts "the delay time Td" for outputting a closing signal such that closing may be established at a closing time Ta corresponding to the target electrical phase angle for each of the R, S and T phases, or at the closing time Ta corresponding to the target electrical phase angle of each of the R-to-S, S-to-T and T-to-R phase voltage, and provides a closing command to each of the switching mechanisms (2*a*), (2*b*), and (2*c*). When the switching equipment is closed for the transformer (3) at the predetermined closing time according to this command, transient phenomena can be suppressed, in principle.

Ideal energizing timing for system equipment such as transmission lines and capacitor banks is at the peak voltage or zero point of each phase-to-phase voltage, but not at an electrical phase angle of the source voltage of each phase. Therefore, more accurate closing can be realized by detecting not only the zero voltage point of the source voltage of each of the R, S and T phases but also the zero voltage point of each of the R-to-S, S-to-T and T-to-R phase voltage to determine the closing time. Also, because the closing time of switching equipment inevitably varies due to the variations in the mechanical characteristics of the switching equipment and the occurrence of discharge, ideal closing is not always realized.

These variations in closing time are on the order of ±0.5 ms in switching devices with high closing speed, and on the order of ±1.0 ms in the switching devices of low-speed closing. The closing time variations of ±0.5 ms and ±1.0 ms correspond to ±10 and ±20 degrees in commercial frequency, respectively. When the real energizing timing for. system equipment such as transmission lines and capacitor banks deviates from an ideal energizing phase angle by the order of ±10 degrees (about ±0.5 ms from the ideal closing time), the surge voltage and exciting inrush current may rise up to about the surge level which can be suppressed by the switching device of the resistor insertion system. This level can be allowable in practical use.

Therefore, the present embodiment can provide a switching apparatus wherein the variations in the closing time thereof can be controlled to within ±10 degrees (less than ±0.5 ms from a predetermined closing time).

When this embodiment is applied to a switching apparatus with low closing speed, the real closing can deviate from the ideal closing phase angle by about ±20 degrees (about ±1.0 ms from the ideal closing time). Thereby, the surge voltage or inrush current occurred can be, at maximum, half of the surge level generated by the switching devices in which the closing phases are not controlled.

In systems where these surge levels are problems in practical use, by using the surge absorber(15) provided between each of the R, S, and T phases and ground for suppressing over-voltages and the surge absorbers(16) for suppressing R-to-S, S-to-T and T-to-R phase over-voltages, the transient phenomena can be suppressed to minimize voltage disturbances in each of the R, S, and T phase voltage and in each of the R-to-S, S-to-T and T-to-R phase voltage.

Further, each of the surge absorber (15), (16) can suppress transient phenomena caused by switching of other switching equipment to improve the zero point detection accuracy and hence energizing accuracy.

Embodiment 13

More specification, using the synchronous switching apparatus of the present embodiment according to the sequence of claim 12, by the method of detecting each of the phase voltage, capacitor banks with a neutral point grounded or transmission lines without trapped charge are energized with a source voltage, first, the zero point of the first phase (R phase) source voltage is detected, so that the first phase (R phase) is energized at an electrical phase angle of the first phase (R phase) within the range of from −20 to 20 degrees, preferably within the range of from −10 to 10 degrees. At this timing, the voltage applied to the R phase is zero or small, so that transient currents are not generated. Also, when the energizing electrical phase angle becomes as large as 0 ±20 degrees, the surge absorber (15*a*) provided between the bus (10*a*) for the R phase and ground for suppressing over-voltages and the surge absorbers (16) for suppressing the R-to-S, S-to-T and T-to-R phase over-voltages can suppress the transient phenomena.

Next, the zero point of the third phase (T phase) source voltage is detected at a time ⅓ of a cycle after the energizing time of the first phase (R phase), and the third phase (T phase) is energized at an electrical phase angle of the third phase (T phase) within the range of from −20 to 20 degrees, preferably within the range of from −10 to 10 degrees. At this timing, the voltage applied to the T phase is zero or small, so that transient currents can not be generated. Also, when the electrical phase angle becomes as large as 0 ±20 degrees, the surge absorber (15*b*) provided between the bus (10*c*) for the R phase and ground for suppressing over-voltages and the surge absorbers (16) for suppressing the phase-to-phase over-voltages can suppress the transient phenomena.

Finally, the zero point of the second phase (S phase) source voltage is detected at a time ⅓ of a cycle after the energizing time of the third phase (T phase), and the second phase (S phase) is energized at an electrical phase angle of the second phase (S phase) within the range of from −20 to 20 degrees, preferably within the range of from −10 to 10 degrees. At this timing, the voltage applied to the S phase is zero or small, so that transient currents can not be generated. Also, when the electrical phase angle becomes as large as 0 ±20 degrees, the transient phenomena can be suppressed by the surge absorber (15*b*) provided between the bus (10*b*) for the S phase and ground for suppressing over-voltages and the surge absorbers (16) for suppressing the phase-to-phase over-voltages.

Embodiment 14

Using the synchronous switching apparatus of the present embodiment according to the sequence of claim 13, by the method of detecting each phase-to-phase voltage, when capacitor banks with a neutral point grounded or transmission lines without trapped charge are energized with a source voltage, first, the zero point of the first-to-second phase (R-to-S phase) voltage is detected, so that the first phase (R phase) is energized at an electrical phase angle of the first-to-second phase (R-to-S phase) voltage within the range of from −50 to −10 degrees, preferably within the range of from −40 to −20 degrees. At this timing, the voltage applied to the R phase is zero or small, so that transient currents are not generated. Also, when the energizing electrical phase angle becomes as large as −30 ±20 degrees, the transient phenomena can be suppressed by the surge absorber (15*a*) provided between the bus (10*a*) for the R phase and ground for suppressing over-voltages and the surge absorbers (16) for suppressing each of the R-to-S, S-to-T and T-to-R phase over-voltages.

Next, the zero point of the third-to-first phase (T-to-R phase) voltage is detected at a time ⅓ of a cycle after the energizing time of the first phase (R phase), and the third phase (T phase) is energized at an electrical phase angle of the third-to-first phase (T-to-R phase) voltage within the range of from −50 to −10 degrees, preferably within the range of from −40 to −20 degrees. At this timing, the voltage applied to the T phase is zero or small, so that transient currents can not be generated. Also, when the electrical phase angle becomes as large as −30 ±20 degrees, the transient phenomena can be suppressed by the surge absorber(15*c*) provided between the bus (10*c*) for the T phase and ground for suppressing over-voltages and the surge absorbers (16) for suppressing the phase-to-phase over-voltages. Finally, the zero point of the second-to-third phase (S-to-T phase) voltage is detected at a time ⅓ of a cycle after the energizing time of the third phase (T phase), and the second phase (S phase) is energized at an electrical phase angle of the second-to-third phase (S-to-T phase) voltage within the range of from −50 to 10 degrees, preferably within the range of from −40 to −20 degrees.

At this timing, the voltage applied to the S phase is zero or small, so that the transient currents can not be created. Also, when the energizing electrical phase angle becomes as large as 0 ±20 degrees, the transient phenomena can be suppressed by the surge absorber (15*b*) provided between the bus for the S phase (10*b*) and ground for suppressing over-voltages and the surge absorbers (16) for suppressing the phase-to-phase over-voltages.

Embodiment 15

Using the synchronous switching apparatus of the invention according to the sequence of claim 14, by the method of detecting each of the phase voltage, when capacitor banks with a neutral point ungrounded are energized with a source voltage, first, the first phase (R) is energized at any time.

With the neutral point ungrounded, energizing of one phase does not cause the transient phenomena because a current path is not formed between the phases. Energizing is generally set near at the peak or in the 0-to-120 degree range of the electrical phase angle of the R phase in which discharge is difficult to occur. Then, after the energizing of the first phase (R phase), the zero point of the third phase (T phase) source voltage is detected, and the third phase (T phase) is energized at an electrical phase angle of the third phase (T phase) within the 10-to-50 degree range, preferably within the 20-to-40 degree range. At this time, a current path is formed between the R and S phases, but because the T-to-R phase voltage is zero or small, transient currents can not be created.

Also, when the energizing electrical phase angle becomes as large as 30 ±20 degrees, the surge absorbers (16) for suppressing the phase-to-phase over-voltages can suppress the transient phenomena.

Finally, the zero point of the second phase (S phase) source voltage is detected at a time ¼ of a cycle after the energizing time of the third phase (T phase), and the second phase (S phase) is energized at an electrical phase angle of the second phase (S phase) within the range of from −20 to 20 degrees, preferably within the range of from −10 to 10 degrees. The voltage applied to the S phase at this time is zero or small, so that the transient currents can not be created. Also, when the energizing electrical phase angle becomes as large as 0 ±20 degrees, the surge absorbers (16) for suppressing the phase-to-phase over-voltages can suppress the transient phenomena.

Embodiment 16

Using the synchronous switching apparatus of the present embodiment according to the sequence of claim 15, by the method of detecting each of the phase voltage, when capacitor banks with a neutral point ungrounded are energized with a source voltage, first, the second phase (S phase) is energized at any time. Then, after the energizing of the second phase (S phase), the zero point of the first phase (R phase) source voltage is detected, so that the first phase (R phase) is energized at an electrical phase angle of the first phase (R phase) within the 10-to-50 degree range, preferably within the 20-to-40 degree range. At this timing, a current path is formed between the R and S phases, but then the R-to-S phase voltage is zero or small, so that the transient currents can not be created. Also, when the energizing electrical phase angle becomes as large as 30 ±20 degrees, the surge absorbers (16) for suppressing the phase-to-phase over-voltages can suppress the transient phenomena.

Finally, the zero point of the third phase (T phase) source voltage is detected at a time ¼ of a cycle after the energizing time of the first phase (R phase), and the third phase (T phase) is energized at an electrical phase angle of the third phase (T phase) within the range of from −20 to 20 degrees, preferably within the range of from −10 to 10 degrees. Also, when the energizing electrical phase angle becomes as large as 0 ±20 degrees, the surge absorbers(16) for suppressing the phase-to-phase over-voltages can suppress the transient phenomena.

Embodiment 17

Using the synchronous switching apparatus of the invention according to the sequence of claim 16, by the method of detecting each of the phase voltage, when capacitor banks with a neutral point ungrounded are energized with a source voltage, first, the third phase (T phase) is energized at any time. Then, after the energizing of the third phase (T phase), the zero point of the second phase (S phase) source voltage is detected, so that the second phase (S phase) is energized at an electrical phase angle of the second phase (S phase) within the 10-to-50 degree range, preferably within the 20-to-40 degree range. At this timing, a current path is formed between the S and T phases, but then the S-to-T phase voltage is zero or small, so that the transient currents can not be created. Also, when the energizing electrical phase angle becomes as large as 30 ±20 degrees, the surge absorbers (16) for suppressing the phase-to-phase over-voltages can suppress the transient phenomena.

Finally, the zero point of the first phase (R phase) source voltage is detected at the time ¼ of a cycle after the energizing time of the second phase (S phase), and the first phase (R phase) is energized at an electrical phase angle of the first phase (R phase)within the range of from −20 to 20 degrees, preferably within the range of from −10 to 10 degrees. Also, when the energizing electrical phase angle becomes as large as 0 ±20 degrees, the surge absorbers (16) for suppressing the phase-to-phase over-voltages can suppress the transient phenomena.

Embodiment 18

Using the synchronous switching apparatus of the present embodiment according to the sequence described in claim 17, by the method of detecting each of the phase voltage, when capacitor banks with a neutral point ungrounded are energized with a source voltage, first, the first phase (R phase) is energized at any time. With the neutral point ungrounded, energizing of one phase does not cause transient phenomena because a current path is not formed between the phases. Energizing is generally set near at the peak or near in the 0-to-120 degree range of the electrical phase angle of the R phase in which discharge is difficult to occur. Then, after the energizing of the first phase (R phase), the zero point of the third-to-first phase (T-to-R phase) voltage is detected, so that the third phase (T phase) is energized at an electrical phase angle of the third-to-first phase (T-to-R phase) voltage within the range of from −20 to 20 degrees, preferably within the range of from −10 to 10 degrees. At this timing, a current path is formed between the T and R phases, but then the T-to-R phase voltage is zero or small, so that the transient currents can not be created. Also, when the energizing electrical phase angle becomes as large as 0 ±20 degrees, the surge absorbers (16) for suppressing the phase-to-phase over-voltages can suppress the transient phenomena.

Finally, the zero point of the second-to-third phase (S-to-T phase) voltage is detected at a time ¼ of a cycle after the energizing time of the third phase (T phase), and the second phase (S phase) is energized at an electrical phase angle of the second-to-third phase (S-to-T phase) voltage within the range of from −50 to -10 degrees, preferably within the range of from −40 to 20 degrees. At this time, the voltage applied to the S phase is zero or small, so that the transient currents can not be created. Also, when the energizing electrical phase angle becomes as large as 30 ±20 degrees, the surge absorbers (16) for suppressing each of the phase-to-phase over-voltages can suppress the transient phenomena.

Embodiment 19

Using the synchronous switching apparatus of the present embodiment according to the sequence of claim 18, by the method of detecting each of the phase voltage, when capacitor banks with a neutral point ungrounded are energized with a source voltage, first, the second phase (S phase) is energized at any time. Then, after the energizing of the second phase (S phase), the zero point of the first-to-second phase (R-to-S phase) voltage is detected, so that the first phase (R phase) is energized at an electrical phase angle of the first-to-second phase (R-to-S phase) voltage within the range of from −20 to 20 degrees, preferably within the range of from −10 to 10 degrees. At this timing, a current path is formed between the R and S phases, but then the R-to-S phase voltage is zero or small, so that the transient currents can not be created.

Also, when the energizing electrical phase angle becomes as large as 0 ±20 degrees, the surge absorbers (16) for suppressing the phase-to-phase over-voltages can suppress the transient phenomena. Finally, the zero point of the third-to-first phase (T-to-R phase) voltage is detected at a time ¼ of a cycle after the energizing time of the first phase (R phase), and the third phase (T phase) is energized at an electrical phase angle of the third-to-first phase (T-to-R phase) voltage within the range of from −50 to −10 degrees, preferably within the range of from −40 to 20 degrees. Also, when the energizing electrical phase angle becomes as large as −30 ±20 degrees, the surge absorbers (16) for suppressing the phase-to-phase over-voltages can suppress the transient phenomena.

Embodiment 20

Using the synchronous switching apparatus of the present embodiment according to the sequence of claim 19, by the method of detecting each of the phase voltage, when capacitor banks with a neutral point ungrounded are energized with a source voltage, first, the third phase (T phase) is energized at any time. Then, after the energizing of the third phase (T phase), the zero point of the second-to-third phase (S-to-T phase) voltage is detected, so that the second phase (S phase) is energized at an electrical phase angle of the second-to-third phase (S-to-T phase) voltage within the range of from −20 to 20 degrees, preferably within the range of from −10 to 10 degrees. At this timing, a current path is formed between the S and T phases, but then the S-to-T phase voltage is zero or small, so that the transient currents can not be created. Also, when the energizing electrical phase angle becomes as large as 0 ±20 degrees, the surge absorbers (16) for suppressing the phase-to-phase over-voltages can suppress the transient phenomena. Finally, the zero point of the first-to-second phase (R-to-S phase) voltage is detected at a time ¼ of a cycle after the energizing time of the second phase (S phase), and the first phase (R phase) is energized at an electrical phase angle of the first-to-second phase (R-to-S phase) voltage within the range of from −50 to −10 degrees, preferably within the range of from −40 to 20 degrees.

Also, when the energizing electrical phase angle becomes as large as −30 ±20 degrees, the surge absorbers (16) for suppressing the phase-to-phase over-voltages can suppress the transient phenomena.

This embodiment provides closing timing which can suppress the occurrence of transient inrush currents and surge voltages, and which can be realized by a switching device for each phase, even if real energizing timing deviates from ideal energizing timing.

Industrial Applicability

The invention provides closing timing which can suppress the occurrence of transient inrush currents and surge voltages, and which can be realized by switching equipment for each phase, even if the real closing time of the switching device deviates from the ideal closing time due to the mechanical characteristics of the switching device.

What is claimed is:

1. A synchronous switching apparatus for use with a multiple phase power system having a plurality of phases and for detecting a source voltage of each phase and energizing each phase at an electrical phase angle predetermined for each phase, comprising:

a plurality of switching devices, one switching device being provided for each phase and opening and closing an impedance load;

a plurality of switching mechanisms, closing and opening the switching devices;

a plurality of voltage measuring transformers, measuring source voltages of the phases;

a plurality of phase-to-phase voltage measuring transformers, measuring respective phase-to-phase voltages; and a plurality of phase control devices, one phase control device being provided for each phase and issuing a command to energize the impedance load with a source voltage at an electrical phase angle in a range predetermined for the phase, in response to detection of a zero point of a source voltage of the phase by the voltage measuring transformer or to detection of a zero point of the phase-to-phase voltage by the phase-to-phase voltage measuring transformer, wherein the synchronous switching apparatus is adapted for use with an impedance load in the form of a single-phase core transformer or shunt reactor with a neutral point grounded, wherein:

the plurality of phases comprises a first phase (R phase), a second phase (S phase), and a third phase (T phase);

the plurality of voltage measuring transformers comprises a first, a second, and a third voltage measuring transformer, measuring source voltages of the first, second, and third phases, respectively; and the predetermined electrical phase angles of each of the first, second, and third phases are within a range of 90 degrees (voltage peak value of the R, S, and T phases) ±20 degrees, wherein, the impedance load is energized with a source voltage via a command sequence, wherein the phase control devices respectively issue a first command for energizing the first phase (R phase) at the predetermined electrical phase angle of the first phase in response to detection of a zero point of a first phase (R phase) source voltage by the first voltage measuring transformer, a second command for energizing the third phase (T phase) at the predetermined electrical phase angle of the third phase in response to detection of a zero point of a third phase (T phase) source voltage by the third voltage measuring transformer at a time around ⅓ of a cycle after an energizing time of the first phase (R phase), and a third command for energizing the second phase (S phase) at the predetermined electrical phase angle of the second phase in response to detection of a zero point of a second phase (S phase) source voltage by the second voltage measuring transformer at a time around ⅓ of a cycle after an energizing time of the third phase (T phase).

2. A synchronous switching apparatus for use with a multiple phase power system having a plurality of phases and for detecting a source voltage of each phase and energizing each phase at an electrical phase angle predetermined for each phase, comprising:

a plurality of switching devices, one switching device being provided for each phase and opening and closing an impedance load;

a plurality of switching mechanisms, closing and opening the switching devices;

a plurality of voltage measuring transformers, measuring source voltages of the phases;

a plurality of phase-to-phase voltage measuring transformers, measuring respective phase-to-phase voltages; and a plurality of phase control devices, one phase control device being provided for each phase and issuing a command to energize the impedance load with a source voltage at an electrical phase angle in a range predetermined for the phase, in response to detection of a zero point of a source voltage of the phase by the voltage measuring transformer or to detection of a zero point of the phase-to-phase voltage by the phase-to-phase voltage measuring transformer, wherein the synchronous switching apparatus is adapted for use with an impedance load in the form of a single-phase core transformer or shunt reactor with a neutral point grounded, wherein:

the plurality of phases comprises a first phase (R phase), a second phase (S phase), and a third phase (T phase);

the plurality of phase-to-phase voltage measuring transformers comprises a first-to-second (R-to-S phase), a second-to-third (S-to-T phase), and a third-to-first (T-to-R phase) phase voltage measuring transformer, measuring a first-to-second, a second-to-third, and a third-to-first phase voltage, respectively; and the predetermined electrical phase angles of each of the first-to-second phase voltage, the second-to-third phase voltage, and the third-to-first phase voltage are within a range of 60 degrees ±20 degrees, wherein, the impedance load is energized with a source voltage via a command sequence, wherein the phase control devices respectively issue a first command for energizing the first phase (R phase) at the predetermined electrical phase angle of the first-to-second phase (R-to-S phase) voltage in response to detection of a zero point of the first-to-second phase (R-to-S phase) voltage by the first-to-second phase voltage measuring transformer, a second command for energizing the third phase (T phase) at the predetermined electrical phase angle of the third-to-first phase (T-to-R phase) voltage in response to detection of a zero point of the third-to-first phase (T-to-R phase) voltage by the third-to-first phase voltage measuring transformer at a time around ⅓ of a cycle after an energizing time of the first phase, and a third command for energizing the second phase (S phase) at the predetermined electrical phase angle of the second-to-third phase (S-to-T phase) voltage in response to detection of a zero point of the second-to-third phase (S-to-T phase) voltage by the second-to-third phase voltage measuring transformer at a time around ⅓ of a cycle after an energizing time of the third phase (T phase).

3. A synchronous switching apparatus for use with a multiple phase power system having a plurality of phases and for detecting a source voltage of each phase and energizing each phase at an electrical phase angle predetermined for each phase, comprising:

a plurality of switching devices, one switching device being provided for each phase and opening and closing an impedance load;

a plurality of switching mechanisms, closing and opening the switching devices;

a plurality of voltage measuring transformers, measuring source voltages of the phases;

a plurality of phase-to-phase voltage measuring transformers, measuring respective phase-to-phase voltages; and a plurality of phase control devices, one phase control device being provided for each phase and issuing a command to energize the impedance load with a source voltage at an electrical phase angle in a range predetermined for the phase, in response to detection of a zero point of a source voltage of the phase by the voltage measuring transformer or to detection of a zero point of the phase-to-phase voltage by the phase-to-phase voltage measuring transformer, wherein the synchronous switching apparatus is adapted for use with an impedance load in the form of a three-phase core transformer or shunt reactor having star-connected windings with a neutral point grounded, wherein:

the plurality of phases comprises a first phase (R phase), a second phase (S phase), and a third phase (T phase);

the plurality of voltage measuring transformers comprises a first and a third voltage measuring transformer, measuring source voltages of the first and third phases, respectively;

the predetermined electrical phase angle of the first phase is within a range of 90 degrees (voltage peak value of the R phase) ±20 degrees; and the predetermined electrical phase angle of the third phase is within a range of 60 degrees ±20 degrees, wherein, the impedance load is energized with a source voltage via a command sequence, wherein the phase control devices respectively issue a first command for energizing the first phase (R phase) at the predetermined electrical phase angle of the first phase in response to detection of a zero point of a first phase (R phase) source voltage by a first voltage measuring transformer, a second command for energizing the third phase (T phase) at the predetermined electrical phase angle of the third phase in response to detection of a zero point of a third phase (T phase) source voltage by the third voltage measuring transformer at a time around ¼ of a cycle after an energizing time of the first phase (R phase), and a third command for energizing the second phase (S phase) at any time after the energizing of the third phase (T phase).

4. A synchronous switching apparatus for use with a multiple phase power system having a plurality of phases and for detecting a source voltage of each phase and energizing each phase at an electrical phase angle predetermined for each phase, comprising:

a plurality of switching devices, one switching device being provided for each phase and opening and closing an impedance load;

a plurality of switching mechanisms, closing and opening the switching devices;

a plurality of voltage measuring transformers, measuring source voltages of the phases;

a plurality of phase-to-phase voltage measuring transformers, measuring respective phase-to-phase voltages; and a plurality of phase control devices, one phase control device being provided for each phase and issuing a command to energize the impedance load with a source voltage at an electrical phase angle in a range predetermined for the phase, in response to detection of a zero point of a source voltage of the phase by the voltage measuring transformer or to detection of a zero point of the phase-to-phase voltage by the phase-to-phase voltage measuring transformer, wherein the synchronous switching apparatus is adapted for use with an impedance load in the form of a single-phase core transformer or shunt reactor with a neutral point grounded, wherein:

the plurality of phases comprises a first phase (R phase), a second phase (S phase), and a third phase (T phase);

the predetermined electrical phase angle of the first phase is within a range of 90 degrees (voltage peak value of the R phase) ±20 degrees;

the predetermined electrical phase angle of the second phase is within a range of −30 degrees ±20 degrees; and the plurality of voltage measuring transformers comprises a first and a second voltage measuring transformer, measuring source voltages of the first and second phases, respectively, wherein, the impedance load is energized with a source voltage via a command sequence, wherein the phase control devices respectively issue a first command for energizing a first phase (R phase) at the predetermined electrical phase angle of the first phase in response to detection of a zero point of the first phase (R phase) source voltage by the first voltage measuring transformer, a second command for energizing a second phase (S phase) at the predetermined electrical phase angle of the second phase in response to detection of a zero point of a second phase (S phase) source voltage by the second voltage measuring transformer at a time around ¼ of a cycle after an energizing time of the first phase, and a third command for energizing a third phase (T phase) at any time after the energizing of the second phase (S phase).

5. A synchronous switching apparatus for use with a multiple phase power system having a plurality of phases and for detecting a source voltage of each phase and energizing each phase at an electrical phase angle predetermined for each phase, comprising:

a plurality of switching devices, one switching device being provided for each phase and opening and closing an impedance load;

a plurality of switching mechanisms, closing and opening the switching devices;

a plurality of voltage measuring transformers, measuring source voltages of the phases;

a plurality of phase-to-phase voltage measuring transformers, measuring respective phase-to-phase voltages; and a plurality of phase control devices, one phase control device being provided for each phase and issuing a command to energize the impedance load with a source voltage at an electrical phase angle in a range predetermined for the phase, in response to detection of a zero point of a source voltage of the phase by the voltage measuring transformer or to detection of a zero point of the phase-to-phase voltage by the phase-to-phase voltage measuring transformer, wherein the synchronous switching apparatus is adapted for use with an impedance load in the form of a single-phase core transformer or shunt reactor with a neutral point grounded, wherein:

the plurality of phases comprises a first phase (R phase), a second phase (S phase), and a third phase (T phase);

the plurality of phase-to-phase voltage measuring transformers comprises a first-to-second (R-to-S phase) and a third-to-first (T-to-R phase) phase voltage measuring transformer, measuring a first-to-second and a third-to-first phase voltage, respectively;

the predetermined electrical phase angle of the first-to-second phase voltage is within a range of 60 degrees ±20 degrees; and the predetermined electrical phase angle of the third-to-first phase voltage is within a range of 30 degrees ±20 degrees, wherein, the impedance load is energized with a source voltage via a command sequence, wherein the phase control devices respectively issue a first command for energizing the first phase (R phase) at the predetermined electrical phase angle of the first-to-second phase (R-to-S phase) voltage in response to detection of a zero point of the first-to-second phase (R-to-S phase) voltage by the first-to-second phase voltage measuring transformer, a second command for energizing the third phase (T phase) at the predetermined electrical phase angle of the third-to-first phase (T-to-R phase) voltage in response to detection of a zero point of a third-to-first phase (T-to-R phase) voltage by the third-to-first phase voltage measuring transformer at a time around ⅓ of a cycle after an energizing time of the first phase (R phase), and a third command for energizing a second phase (S phase) at any time after the energizing of the third phase (T phase).

6. A synchronous switching apparatus for use with a multiple phase power system having a plurality of phases and for detecting a source voltage of each phase and energizing each phase at an electrical phase angle predetermined for each phase, comprising:

a plurality of switching devices, one switching device being provided for each phase and opening and closing an impedance load;

a plurality of switching mechanisms, closing and opening the switching devices;

a plurality of voltage measuring transformers, measuring source voltages of the phases;

a plurality of phase-to-phase voltage measuring transformers, measuring respective phase-to-phase voltages; and a plurality of phase control devices, one phase control device being provided for each phase and issuing a command to energize the impedance load with a source voltage at an electrical phase angle in a range predetermined for the phase, in response to detection of a zero point of a source voltage of the phase by the voltage measuring transformer or to detection of a zero point of the phase-to-phase voltage by the phase-to-phase voltage measuring transformer, wherein the synchronous switching apparatus is adapted for use with an impedance load in the form of a three-phase core transformer or shunt reactor having star-connected windings with a neutral point grounded, wherein:

the plurality of phases comprises a first phase (R phase), a second phase (S phase), and a third phase (T phase);

the plurality of phase-to-phase voltage measuring transformers comprises a first-to-second (R-to-S phase), and a second-to-third (S-to-T phase), measuring a first-to-second and a second-to-third phase voltage, respectively; and the predetermined electrical phase angle of the first-to-second phase voltage is within a range of 60 degrees ±20 degrees; and the predetermined electrical phase angle of the second-to-third phase voltage is within a range of −60 degrees ±20 degrees, wherein the impedance load is energized with a source voltage via a command sequence, wherein the phase control devices respectively issue a first command for energizing the first phase (R phase) at the predetermined electrical phase angle of the first-to-second phase (R-to-S phase) voltage in response to detection of a zero point of the first-to-second phase (R-to-S phase) voltage by the first-to-second phase voltage measuring transformer, a second command for energizing the second phase (T phase) at the predetermined electrical phase angle of the second-to-third phase (S-to-T phase) voltage in response to detection of a zero point of the second-to-third phase (S-to-T phase) voltage by the second-to-third phase voltage measuring transformer at a time around ⅓ of a cycle after an energizing time of the first phase (R phase), and a third command for energizing the third phase (T phase) at any time after the energizing of the second phase (S phase).

7. A synchronous switching apparatus for use with a multiple phase power system having a plurality of phases and for detecting a source voltage of each phase and energizing each phase at an electrical phase angle predetermined for each phase, comprising:

a plurality of switching devices, one switching device being provided for each phase and opening and closing an impedance load;

a plurality of switching mechanisms, closing and opening the switching devices;

a plurality of voltage measuring transformers, measuring source voltages of the phases;

a plurality of phase-to-phase voltage measuring transformers, measuring respective phase-to-phase voltages; and a plurality of phase control devices, one phase control device being provided for each phase and issuing a command to energize the impedance load with a source voltage at an electrical phase angle in a range predetermined for the phase, in response to detection of a zero point of a source voltage of the phase by the voltage measuring transformer or to detection of a zero point of the phase-to-phase voltage by the phase-to-phase voltage measuring transformer, wherein the synchronous switching apparatus is adapted for use with an impedance load in the form of a three-phase core transformer or shunt reactor having star-connected windings with a neutral point ungrounded, or a delta connection transformer or shunt reactor, wherein:

the plurality of phases comprises a first phase (R phase), a second phase (S phase), and a third phase (T phase);

the plurality of voltage measuring transformers comprises a first and a third voltage measuring transformer, measuring source voltages of the first and third phases, respectively;

the predetermined electrical phase angle of the first phase is within a range of 120 degrees ±20 degrees; and the predetermined electrical phase angle of the third phase is within a range of 90 degrees ±20 degrees;

wherein, the impedance load is energized with a source voltage via a command sequence, wherein the phase control devices respectively issue a first command for energizing the second phase (S phase) at any time, a second command for energizing the first phase (R phase) at the predetermined electrical phase angle of the first phase (R phase) in response to detection of a zero point of a first (R phase) source voltage by the first voltage measuring transformer after the energizing of the second phase (S phase), and a third command for energizing the third phase (T phase) at the predetermined electrical phase angle of the third phase (T phase) in response to detection of a zero point of a third phase (T phase) source voltage by the third voltage measuring transformer at a time around ⅓ of a cycle after an energizing time of the first phase (R phase).

8. A synchronous switching apparatus for use with a multiple phase power system having a plurality of phases and for detecting a source voltage of each phase and energizing each phase at an electrical phase angle predetermined for each phase, comprising:

a plurality of switching devices, one switching device being provided for each phase and opening and closing an impedance load;

a plurality of switching mechanisms, closing and opening the switching devices;

a plurality of voltage measuring transformers, measuring source voltages of the phases;

a plurality of phase-to-phase voltage measuring transformers, measuring respective phase-to-phase voltages; and a plurality of phase control devices, one phase control device being provided for each phase and issuing a command to energize the impedance load with a source voltage at an electrical phase angle in a range predetermined for the phase, in response to detection of a zero point of a source voltage of the phase by the voltage measuring transformer or to detection of a zero point of the phase-to-phase voltage by the phase-to-phase voltage measuring transformer, wherein the synchronous switching apparatus is adapted for use with an impedance load in the form of a three-phase core transformer or shunt reactor having star-connected windings with a neutral point ungrounded, or a single-phase core and three-phase core delta connection transformer or shunt reactor, wherein:

the plurality of phases comprises a first phase (R phase), a second phase (S phase), and a third phase (T phase);

the plurality of voltage measuring transformers comprises a second and a third voltage measuring transformer, measuring source voltages of the second and third phases, respectively;

the predetermined electrical phase angle of the second phase is within a range of −120 degrees ±20 degrees; and the predetermined electrical phase angle of the third phase is within a range of 90 degrees ±20 degrees;

wherein, the impedance load is energized with a source voltage via a command sequence, wherein the phase control devices respectively issue a first command for energizing the first phase (R phase) at any time, a second command for energizing the second phase (S phase) at the predetermined electrical phase angle of the second phase (S phase) in response to detection of a zero point of a second phase (S phase) source voltage by the second voltage measuring transformer after the energizing of the first phase (R phase), and a third command for energizing the third phase (T phase) at the predetermined electrical phase angle of the third phase (T phase) in response to detection of a zero point of a third phase (T phase) source voltage at a time around ⅓ of a cycle after an energizing time of the second phase (S phase).

9. A synchronous switching apparatus for use with a multiple phase power system having a plurality of phases and for detecting a source voltage of each phase and energizing each phase at an electrical phase angle predetermined for each phase, comprising:

a plurality of switching devices, one switching device being provided for each phase and opening and closing an impedance load;

a plurality of switching mechanisms, closing and opening the switching devices;

a plurality of voltage measuring transformers, measuring source voltages of the phases;

a plurality of phase-to-phase voltage measuring transformers, measuring respective phase-to-phase voltages; and a plurality of phase control devices, one phase control device being provided for each phase and issuing a command to energize the impedance load with a source voltage at an electrical phase angle in a range predetermined for the phase, in response to detection of a zero point of a source voltage of the phase by the voltage measuring transformer or to detection of a zero point of the phase-to-phase voltage by the phase-to-phase voltage measuring transformer, wherein the synchronous switching apparatus is adapted for use with an impedance load in the form of a three-phase core transformer or shunt reactor having star-connected windings with a neutral point ungrounded, or a single-phase core and three-phase core delta connection transformer or shunt reactor, wherein:

the plurality of phases comprises a first phase (R phase), a second phase (S phase), and a third phase (T phase);

the plurality of phase-to-phase voltage measuring transformers comprises a first-to-second (R-to-S phase) and a third-to-first (T-to-R phase) phase voltage measuring transformer, measuring a first-to-second and a third-to-first phase voltage, respectively;

the predetermined electrical phase angle of the first-to-second phase voltage is within a range of 90 degrees ±20 degrees; and the predetermined electrical phase angle of the third-to-first phase voltage is within a range of 60 degrees ±20 degrees, wherein, the impedance load is energized with a source voltage via a command sequence, wherein the phase control devices respectively issue a first command for energizing the second phase (S phase) at any time, a second command for energizing the first phase (R phase) at the predetermined electrical phase angle of a first-to-second phase (R-to-S phase) voltage in response to detection of a zero point of a first-to-second phase (R-to-S phase) voltage by the first-to-second phase voltage measuring transformer after an energizing time of the second phase (S phase), and a third command for energizing the third phase (T phase) at the predetermined electrical phase angle of a third-to-first phase (T-to-R phase) voltage in response to detection of a zero point of a third-to-first phase (T-to-R phase) voltage by the third-to-first phase voltage measuring transformer at a time around ⅓ of a cycle after an energizing time of the first phase (R phase).

10. A synchronous switching apparatus for use with a multiple phase power system having a plurality of phases and for detecting a source voltage of each phase and energizing each phase at an electrical phase angle predetermined for each phase, comprising:

a plurality of switching devices, one switching device being provided for each phase and opening and closing an impedance load;

a plurality of switching mechanisms, closing and opening the switching devices;

a plurality of voltage measuring transformers, measuring source voltages of the phases;

a plurality of phase-to-phase voltage measuring transformers, measuring respective phase-to-phase voltages; and a plurality of phase control devices, one phase control device being provided for each phase and issuing a command to energize the impedance load with a source voltage at an electrical phase angle in a range predetermined for the phase, in response to detection of a zero point of a source voltage of the phase by the voltage measuring transformer or to detection of a zero point of the phase-to-phase voltage by the phase-to-phase voltage measuring transformer, wherein the synchronous switching apparatus is adapted for use with an impedance load in the form of a three-phase core transformer or shunt reactor having star-connected windings with a neutral point ungrounded, or a single-phase core and three-phase core delta connection transformer or shunt reactor, wherein:

the plurality of phases comprises a first phase (R phase), a second phase (S phase), and a third phase (T phase);

the plurality of phase-to-phase voltage measuring transformers comprises a second-to-third (S-to-T phase) and a third-to-first (T-to-R phase) phase voltage measuring transformer, measuring a second-to-third and a third-to-first phase voltage, respectively;

the predetermined electrical phase angle of the second-to-third phase voltage is within a range of −150 degrees ±20 degrees; and the predetermined electrical phase angle of the third-to-first phase voltage is within a range of 60 degrees ±20 degrees, wherein, the impedance load is energized with a source voltage via a command sequence, wherein the phase control devices respectively issue a first command for energizing the first phase (R phase) at any time, a second command for energizing the second phase (S phase) at the predetermined electrical phase angle of a second-to-third phase (S-to-T phase) voltage in response to detection of a zero point of a second-to-third phase (S-to-T phase) voltage by the second-to-third phase voltage measuring transformer after an energizing of the first phase (R phase), and a third command for energizing the third phase (T phase) at the predetermined electrical phase angle of a third-to-first phase (T-to-R phase) voltage in response to detection of a zero point of a third-to-first phase (T-to-R phase) voltage by the third-to-first phase voltage measuring transformer at a time around ⅓ of a cycle after an energizing time of the second phase (S phase).

11. A synchronous switching apparatus for use with a multiple phase power system having a plurality of phases and for detecting a source voltage of each phase and energizing each phase at an electrical phase angle predetermined for each phase, comprising:

a plurality of switching devices, one switching device being provided for each phase and opening and closing an impedance load;

a plurality of switching mechanisms, closing and opening the switching devices;

a plurality of voltage measuring transformers, measuring source voltages of the phases;

a plurality of phase-to-phase voltage measuring transformers, measuring respective phase-to-phase voltages; and a plurality of phase control devices, one phase control device being provided for each phase and issuing a command to energize the impedance load with a source voltage at an electrical phase angle in a range predetermined for the phase, in response to detection of a zero point of a source voltage of the phase by the voltage measuring transformer or to detection of a zero point of the phase-to-phase voltage by the phase-to-phase voltage measuring transformer, wherein the synchronous switching apparatus is adapted for use with an impedance load in the form of capacitor banks with a neutral point grounded or transmission lines without an electric charge, wherein:

the plurality of phases comprises a first phase (R phase), a second phase (S phase), and a third phase (T phase);

the plurality of voltage measuring transformers comprises a first, a second, and a third voltage measuring transformer, measuring source voltages of the first, second, and third phases, respectively; and the predetermined electrical phase angles of each of the first, second, and third phases are within a range of 0 degrees (zero voltage points of the R, S, and T phases) ±20 degrees, wherein, the impedance load is energized with a source voltage via a command sequence, wherein the phase control devices respectively issue a first command for energizing the first phase (R phase) at the predetermined electrical phase angle of the first phase (R phase) in response to detection of a zero point of a first phase (R phase) source voltage by the first voltage measuring transformer, a second command for energizing the third phase (T phase) at the predetermined electrical phase angle of the third phase (T phase) in response to detection of a zero point of a third phase (T phase) source voltage by the third voltage measuring transformer at a time around ⅓ of a cycle after an energizing time of the first phase (R phase), and a third command for energizing the second phase (S phase) at the predetermined electrical phase angle of the second phase (S phase) in response to detection of a zero point of a second phase (S phase) source voltage by the second voltage measuring transformer at a time around ⅓ of a cycle after an energizing time of the third phase (T phase).

12. A synchronous switching apparatus for use with a multiple phase_ power system having a plurality of phases and for detecting a source voltage of each phase and energizing each phase at an electrical phase angle predetermined for each phase, comprising:

a plurality of switching devices, one switching device being provided for each phase and opening and closing an impedance load;

a plurality of switching mechanisms, closing and opening the switching devices;

a plurality of voltage measuring transformers, measuring source voltages of the phases;

a plurality of phase-to-phase voltage measuring transformers, measuring respective phase-to-phase voltages; and a plurality of phase control devices, one phase control device being provided for each phase and issuing a command to energize the impedance load with a source voltage at an electrical phase angle in a range predetermined for the phase, in response to detection of a zero point of a source voltage of the phase by the voltage measuring transformer or to detection of a zero point of the phase-to-phase voltage by the phase-to-phase voltage measuring transformer, wherein the synchronous switching apparatus is adapted for use with an impedance load in the form of capacitor banks with a neutral point grounded or transmission lines without an electrical charge, wherein:

the plurality of phases comprises a first phase (R phase), a second phase (S phase), and a third phase (T phase);

the plurality of phase-to-phase voltage measuring transformers comprises a first-to-second (R-to-S phase), a second-to-third (S-to-T phase), and a third-to-first (T-to-R phase) phase voltage measuring transformer, measuring a first-to-second, a second-to-third, and a third-to-first phase voltage, respectively; and the predetermined electrical phase angles of each of the first-to-second phase voltage, the second-to-third phase voltage, and the third-to-first phase voltage are within a range of −30 degrees ±20 degrees, wherein, the impedance load is energized with a source voltage via a command sequence, wherein the phase control devices respectively issue a first command for energizing the first phase (R phase) at the predetermined electrical phase angle of a first-to-second phase (R-to-S phase) voltage in response to detection of a zero point of a first-to-second phase (R-to-S phase) voltage by the first-to-second phase voltage measuring transformer, a second command for energizing the third phase (T phase) at the predetermined electrical phase angle of a third-to-first phase (T-to-R phase) voltage in response to detection of a zero point of a third-to-first phase (T-to-R phase) voltage by the third-to-first phase voltage measuring transformer at a time around ⅓ of a cycle after an energizing time of the first phase (R phase), and a third command for energizing the second phase (S phase) at the predetermined electrical phase angle of a second-to-third phase (S-to-T phase) voltage in response to detection of a zero point of a second-to-third phase (S-to-T phase) voltage by the second-to-third phase voltage measuring transformer at a time around ⅓ of a cycle after an energizing time of the third phase (T phase).

13. A synchronous switching apparatus for use with a multiple phase power system having a plurality of phases and for detecting a source voltage of each phase and energizing each phase at an electrical phase angle predetermined for each phase, comprising:

a plurality of switching devices, one switching device being provided for each phase and opening and closing an impedance load;

a plurality of switching mechanisms, closing and opening the switching devices;

a plurality of voltage measuring transformers, measuring source voltages of the phases;

a plurality of phase-to-phase voltage measuring transformers, measuring respective phase-to-phase voltages; and a plurality of phase control devices, one phase control device being provided for each phase and issuing a command to energize the impedance load with a source voltage at an electrical phase angle in a range predetermined for the phase, in response to detection of a zero point of a source voltage of the phase by the voltage measuring transformer or to detection of a zero point of the phase-to-phase voltage by the phase-to-phase voltage measuring transformer, wherein the synchronous switching apparatus is adapted for use with an impedance load in the form of capacitor banks with a neutral point ungrounded, wherein:

the plurality of phases comprises a first phase (R phase), a second phase (S phase), and a third phase (T phase);

the plurality of voltage measuring transformers comprises a second and a third voltage measuring transformer, measuring source voltages of the second and third phases, respectively;

the predetermined electrical phase angle of the second phase is within a range of 0 degrees ±20 degrees; and the predetermined electrical phase angle of the third phase is within a range of 30 degrees±20 degrees;

wherein, the impedance load is energized with a source voltage via a command sequence, wherein the phase control devices respectively issue a first command for energizing the first phase (R phase) at any time, a second command for energizing the third phase (T phase) at the predetermined electrical phase angle of the third phase (T phase) in response to detection of a zero point of the third phase (T phase) source voltage by the third voltage measuring transformer after an energizing of the first phase (R phase), and a third command for energizing the second phase (S phase) at the predetermined electrical phase angle of the second phase (S phase) in response to detection of a zero point of a second phase (S phase) source voltage by the second voltage measuring transformer at a time around ¼ of a cycle after an energizing time of the third phase (T phase).

14. A synchronous switching apparatus for use with a multiple phase power system having a plurality of phases and for detecting a source voltage of each phase and energizing each phase at an electrical phase angle predetermined for each phase, comprising:

a plurality of switching devices, one switching device being provided for each phase and opening and closing an impedance load;

a plurality of switching mechanisms, closing and opening the switching devices;

a plurality of voltage measuring transformers, measuring source voltages of the phases;

a plurality of phase-to-phase voltage measuring transformers, measuring respective phase-to-phase voltages; and a plurality of phase control devices, one phase control device being provided for each phase and issuing a command to energize the impedance load with a source voltage at an electrical phase angle in a range predetermined for the phase, in response to detection of a zero point of a source voltage of the phase by the voltage measuring transformer or to detection of a zero point of the phase-to-phase voltage by the phase-to-phase voltage measuring transformer, wherein the synchronous switching apparatus is adapted for use with an impedance load in the form of capacitor banks with a neutral point ungrounded, wherein:

the plurality of phases comprises a first phase (R phase), a second phase (S phase), and a third phase (T phase);

the plurality of voltage measuring transformers comprises a first and a third voltage measuring transformer, measuring source voltages of the first and third phases, respectively;

the predetermined electrical phase angle of the first phase is within a range of 30 degrees±20 degrees; and the predetermined electrical phase angle of the third phase is within a range of 0 degrees±20 degrees;

wherein, the impedance load is energized with a source voltage via a command sequence, wherein the phase control devices respectively issue a first command for energizing the second phase (S phase) at any time, a second command for energizing the first phase (R phase) at the predetermined electrical phase angle of the first phase (R phase) in response to detection of a zero point of a first phase (R phase) source voltage by the first voltage measuring transformer after the energizing of the second phase (S phase), and a third command for energizing the third phase (T phase) at the predetermined electrical phase angle of the third phase (T phase) in response to detection of a zero point of a third phase (T phase) source voltage by the third voltage measuring transformer at a time around ¼ of a cycle after a energizing time of the first phase (R phase).

15. A synchronous switching apparatus for use with a multiple phase power system having a plurality of phases and for detecting a source voltage of each phase and energizing each phase at an electrical phase angle predetermined for each phase, comprising:

a plurality of switching devices, one switching device being provided for each phase and opening and closing an impedance load;

a plurality of switching mechanisms, closing and opening the switching devices;

a plurality of voltage measuring transformers, measuring source voltages of the phases;

a plurality of phase-to-phase voltage measuring transformers, measuring respective phase-to-phase voltages; and a plurality of phase control devices, one phase control device being provided for each phase and issuing a command to energize the impedance load with a source voltage at an electrical phase angle in a range predetermined for the phase, in response to detection of a zero point of a source voltage of the phase by the voltage measuring transformer or to detection of a zero point of the phase-to-phase voltage by the phase-to-phase voltage measuring transformer, wherein the synchronous switching apparatus is adapted for use with an impedance load in the form of capacitor banks with a neutral point ungrounded, wherein:

the plurality of phases comprises a first phase (R phase), a second phase (S phase), and a third phase (T phase);

the plurality of voltage measuring transformers comprises a first and a second voltage measuring transformer, measuring source voltages of the first and second phases, respectively;

the predetermined electrical phase angle of the first phase is within a range of 0 degrees±20 degrees; and the predetermined electrical phase angle of the second phase is within a range of 30 degrees ±20 degrees;

wherein, the impedance load is energized with a source voltage via a command sequence, wherein the phase control devices respectively issue a first command for energizing the third phase (T phase) at any time, a second command for energizing the second phase (S phase) at the predetermined electrical phase angle of the second phase (S phase) in response to detection of a zero point of a second phase (S phase) source voltage by the second voltage measuring transformer after the energizing of the third phase (T phase), and a third command for energizing the first phase (R phase) at the predetermined electrical phase angle of the first phase (R phase) in response to detection of a zero point of a first phase (R phase) source voltage by the first voltage measuring transformer at a time around ¼ of a cycle after an energizing time of the second phase (S phase).

16. A synchronous switching apparatus for use with a multiple phase power system having a plurality of phases and for detecting a source voltage of each phase and energizing each phase at an electrical phase angle predetermined for each phase, comprising:

a plurality of switching devices, one switching device being provided for each phase and opening and closing an impedance load;

a plurality of switching mechanisms, closing and opening the switching devices;

a plurality of voltage measuring transformers, measuring source voltages of the phases;

a plurality of phase-to-phase voltage measuring transformers, measuring respective phase-to-phase voltages; and a plurality of phase control devices, one phase control device being provided for each phase and issuing a command to energize the impedance load with a source voltage at an electrical phase angle in a range predetermined for the phase, in response to detection of a zero point of a source voltage of the phase by the voltage measuring transformer or to detection of a zero point of the phase-to-phase voltage by the phase-to-phase voltage measuring transformer, wherein the synchronous switching apparatus is adapted for use with an impedance load in the form of capacitor banks with a neutral point ungrounded, wherein:

the plurality of phases comprises a first phase (R phase), a second phase (S phase), and a third phase (T phase);

the plurality of phase-to-phase voltage measuring transformers comprises a second-to-third (S-to-T phase) and a third-to-first (T-to-R phase) phase voltage measuring transformer, measuring a second-to-third and a third-to-first phase voltage, respectively;

the predetermined electrical phase angle of the second-to-third phase voltage is within a range of −30 degrees ±20 degrees; and the predetermined electrical phase angle of the third-to-first phase voltage is within a range of 0 degrees ±20 degrees, wherein, the impedance load is energized with a source voltage via a command sequence, wherein the phase control devices respectively issue a first command for energizing the first phase (R phase) at any time, a second command for energizing the third phase (T phase) at the predetermined electrical phase angle of a third-to-first phase (T-to-R phase) voltage in response to detection of a zero point of a third-to-first phase (T-to-R phase) voltage by the third-to-first phase voltage measuring transformer after the energizing of a first phase (R phase), and a third command for energizing the second phase (S phase) at the predetermined electrical phase angle of a second-to-third phase (S-to-T phase) voltage in response to detection of a zero point of a second-to-third phase (S-to-T phase) voltage by the second-to-third phase voltage measuring transformer at a time around ¼ of a cycle after an energizing time of the third phase (T phase).

17. A synchronous switching apparatus for use with a multiple phase power system having a plurality of phases and for detecting a source voltage of each phase and energizing each phase at an electrical phase angle predetermined for each phase, comprising:

a plurality of switching devices, one switching device being provided for each phase and opening and closing an impedance load;

a plurality of switching mechanisms, closing and opening the switching devices;

a plurality of voltage measuring transformers, measuring source voltages of the phases;

a plurality of phase-to-phase voltage measuring transformers, measuring respective phase-to-phase voltages; and a plurality of phase control devices, one phase control device being provided for each phase and issuing a command to energize the impedance load with a source voltage at an electrical phase angle in a range predetermined for the phase, in response to detection of a zero point of a source voltage of the phase by the voltage measuring transformer or to detection of a zero point of the phase-to-phase voltage by the phase-to-phase voltage measuring transformer, wherein the synchronous switching apparatus is adapted for use with an impedance load in the form of capacitor banks with a neutral point ungrounded, wherein:

the plurality of phases comprises a first phase (R phase), a second phase (S phase), and a third phase (T phase);

the plurality of phase-to-phase voltage measuring transformers comprises a first-to-second (R-to-S phase) and a third-to-first (T-to-R phase) phase voltage measuring transformer, measuring a first-to-second and a third-to-first phase voltage, respectively;

the predetermined electrical phase angle of the first-to-second phase voltage is within a range of 0 degrees ±20 degrees; and the predetermined electrical phase angle of the third-to-first phase voltage is within a range of ±30 degrees ±20 degrees, wherein, the impedance load is energized with a source voltage via a command sequence, wherein the phase control devices respectively issue a first command for energizing the second phase (S phase) at any time, a second command for energizing the first phase (R phase) at the predetermined electrical phase angle of a first-to-second phase (R-to-S phase) voltage in response to detection of a zero point of a first-to-second phase (R-to-S phase) voltage by the first-to-second phase voltage measuring transformer after the energizing of the second phase (S phase), and a third command for energizing the third phase (T phase) at the predetermined electrical phase angle of the third-to-first phase (T-to-R phase) voltage in response to detection of a zero point of a third-to-first phase (T-to-R phase) voltage by the third-to-first phase voltage measuring transformer at a time around ¼ of a cycle after a energizing time of the first phase (R phase).

18. A synchronous switching apparatus for use with a multiple phase power system having a plurality of phases and for detecting a source voltage of each phase and energizing each phase at an electrical phase angle predetermined for each phase, comprising:

a plurality of switching devices, one switching device being provided for each phase and opening and closing an impedance load;

a plurality of switching mechanisms, closing and opening the switching devices;

a plurality of voltage measuring transformers, measuring source voltages of the phases;

a plurality of phase-to-phase voltage measuring transformers, measuring respective phase-to-phase voltages; and a plurality of phase control devices, one phase control device being provided for each phase and issuing a command to energize the impedance load with a source voltage at an electrical phase angle in a range predetermined for the phase, in response to detection of a zero point of a source voltage of the phase by the voltage measuring transformer or to detection of a zero point of the phase-to-phase voltage by the phase-to-phase voltage measuring transformer, wherein the synchronous switching apparatus is adapted for use with an impedance load in the form of capacitor banks with a neutral point ungrounded, wherein:

the plurality of phases comprises a first phase (R phase), a second phase (S phase), and a third phase (T phase);

the plurality of phase-to-phase voltage measuring transformers comprises a first-to-second (R-to-S phase) and a second-to-third (S-to-T phase) phase voltage measuring transformer, measuring a first-to-second and a second-to-third phase voltage, respectively;

the predetermined electrical phase angle of the first-to-second phase voltage is within a range of −30 degrees ±20 degrees; and the predetermined electrical phase angle of the second-to-third phase voltage is within a range of 0 degrees ±20 degrees, wherein, the impedance load is energized with a source voltage via a command sequence, wherein the phase control devices respectively issue a first command for energizing the third phase (T phase), a second command for energizing the second phase (S phase) at the predetermined electrical phase angle of a second-to-third phase (S-to-T phase) voltage in response to detection of a zero point of a second-to-third phase (S-to-T phase) voltage by the second-to-third phase voltage measuring transformer after the energizing of the third phase (T phase), and a third command for energizing the first phase (R phase) at the predetermined electrical phase angle of a first-to-second phase (R-to-S phase) voltage in response to detection of a zero point of a first-to-second phase (R-to-S phase) voltage by the first-to-second phase voltage measuring transformer at a time around ¼ of a cycle after an energizing time of the second phase (S phase).

19. A synchronous switching apparatus for use with a multiple phase power system having a plurality of phases and for detecting a source voltage of each phase and energizing each phase at an electrical phase angle predetermined for each phase, comprising:

a plurality of switching devices, one switching device being provided for each phase and opening and closing an impedance load;

a plurality of switching mechanisms, closing and opening the switching devices;

a plurality of voltage measuring transformers, measuring source voltages of the phases;

a plurality of phase-to-phase voltage measuring transformers, measuring respective phase-to-phase voltages;

a plurality of phase control devices, one phase control device being provided for each phase and issuing a command to energize the impedance load with a source voltage at an electrical phase angle in a range predetermined for the phase, in response to detection of a zero point of a source voltage of the phase by the voltage measuring transformer or to detection of a zero point of the phase-to-phase voltage by the phase-to-phase voltage measuring transformer;

surge absorbers provided between respective phases and ground for respectively suppressing surge voltages of respective phases; and surge absorbers provided between respective phases for suppressing phase-to-phase surge voltages.

* * * * *